US011161350B2

(12) United States Patent
Ito et al.

(10) Patent No.: US 11,161,350 B2
(45) Date of Patent: Nov. 2, 2021

(54) CONTROL DEVICE, PRINTING APPARATUS, AND NON-TRANSITORY COMPUTER-READABLE RECORDING MEDIUM

(71) Applicant: BROTHER KOGYO KABUSHIKI KAISHA, Nagoya (JP)

(72) Inventors: Tsuyoshi Ito, Nagoya (JP); Yasuo Ono, Nagoya (JP); Satoru Arakane, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 68 days.

(21) Appl. No.: 16/805,928

(22) Filed: Mar. 2, 2020

(65) Prior Publication Data

US 2020/0282742 A1 Sep. 10, 2020

(30) Foreign Application Priority Data

Mar. 4, 2019 (JP) ..... JP2019-038806

(51) Int. Cl.
*B41J 2/21* (2006.01)
*B41J 13/00* (2006.01)
*B41J 29/393* (2006.01)

(52) U.S. Cl.
CPC ..... *B41J 2/2132* (2013.01); *B41J 13/0027* (2013.01); *B41J 29/393* (2013.01)

(58) Field of Classification Search
CPC ... B41J 2/2132; G06K 15/107; G06K 15/102; G06K 15/105
See application file for complete search history.

(56) References Cited

U.S. PATENT DOCUMENTS

2009/0251499 A1* 10/2009 Santo ..... G06K 15/105 347/9
2018/0093515 A1 4/2018 Ito et al.
2020/0145555 A1* 5/2020 Ito ..... G06F 3/1215

FOREIGN PATENT DOCUMENTS

JP 2005-205849 A 8/2005
JP 2018-052090 A 4/2018

* cited by examiner

*Primary Examiner* — Julian D Huffman
(74) *Attorney, Agent, or Firm* — Scully, Scott, Murphy & Presser, PC

(57) ABSTRACT

A control device is configured to cause a print execution unit to print an image by repetitively executing: partial printing of causing a print head to eject ink while causing a main scanning unit to perform the main scanning; and conveying processing of causing a conveyor to perform a conveyance, and the control device is configured to execute: selection processing of selecting one of first processing and second processing for printing an $N^{th}$ band area when the $N^{th}$ band area includes a blank pixel line extending in a second direction; and execution processing of executing the one of the first processing and the second processing, and in the selection processing, the control device is configured to: select the second processing when a total count condition is satisfied; and select the first processing when the total count condition is not satisfied.

15 Claims, 16 Drawing Sheets

TB1

| j | F1 (C1) | F1 (C2) | F1 (C3) | Fc (j) | Fr (j) |
|---|---|---|---|---|---|
| 1 | 0 | 0 | 1 | 0 | 0 |
| 2 | 0 | 0 | 1 | 0 | 0 |
| 3 | 1 | 0 | 1 | 0 | 0 |
| 4 | 1 | 0 | 1 | 0 | 0 |
| 5 | 1 | 0 | 1 | 0 | 0 |
| 6 | 1 | 1 | 1 | 1 | 0 |
| 7 | 1 | 1 | 1 | 1 | 1 |
| 8 | 1 | 0 | 1 | 0 | 0 |
| 9 | 1 | 0 | 1 | 0 | 0 |
| 10 | 1 | 0 | 1 | 0 | 0 |
| 11 | 1 | 0 | 1 | 0 | 0 |
| 12 | 1 | 0 | 1 | 0 | 0 |
| 13 | 1 | 1 | 1 | 1 | 1 |
| 14 | 1 | 1 | 1 | 1 | 0 |
| 15 | 1 | 1 | 1 | 1 | 0 |
| 16 | 1 | 1 | 1 | 1 | 0 |
| 17 | 1 | 1 | 1 | 1 | 1 |
| 18 | 1 | 1 | 1 | 1 | 0 |
| 19 | 1 | 1 | 0 | 0 | 0 |
| 20 | 1 | 0 | 0 | 0 | 0 |
| 21 | 1 | 0 | 0 | 0 | 0 |
| ⋮ | ⋮ | ⋮ | ⋮ | ⋮ | ⋮ |
| U | 1 | 1 | 1 | 1 | 1 |

CONTROL DEVICE, PRINTING APPARATUS, AND NON-TRANSITORY COMPUTER-READABLE RECORDING MEDIUM

CROSS-REFERENCE TO RELATED APPLICATIONS

This application is based upon and claims the benefit of priority from prior Japanese patent application No. 2019-038806, filed on Mar. 4, 2019, the entire contents of which are incorporated herein by reference.

TECHNICAL FIELD

The present disclosure relates to control processing for forming an image on a printing medium by using a color material.

BACKGROUND

A known printer is configured to print an image by ejecting ink and includes a head having a plurality of nozzles and capable of moving in a predetermined moving direction, and a conveyor configured to convey a medium. The printer is configured to repeat alternately a line group forming operation (also referred to as "pass") of ejecting ink from the plurality of nozzles to form a line group (also referred to as "band area") consisting of a plurality of dots along the predetermined moving direction and a conveying operation of conveying the medium by the conveyor, thereby forming a plurality of the line groups in a medium conveying direction to thus form an image. Herein, following technology is suggested for executing printing so that no image deviation occurs at a joint between the line groups. That is, it is determined whether there are dots adjacent to each other with the pass being interposed. When it is determined that there are dots adjacent to each other with the pass being interposed, it is determined whether there is a blank line, in which no dot is formed, on a downstream side of the dots adjacent to each other with the pass being interposed with respect to the medium conveying direction. When it is determined that there is a blank line, an image that is to be formed on an upstream side of the blank line with respect of the medium conveying direction, is formed in a second next pass.

However, according to the above technology, a printing time may increase due to an increase in total count of the passes.

SUMMARY

The technology of the present disclosure can be implemented as following application examples.

A control device for causing a print execution unit to print an image, the print execution unit including: a print head having a nozzle group for ejecting ink; a conveyor configured to perform conveyance of moving a printing medium relative to the print head in a first direction; and a main scanning unit configured to perform main scanning of moving the print head relative to the printing medium in a direction parallel to a second direction perpendicular to the first direction, the control device being configured to cause the print execution unit to print the image by repetitively executing: partial printing of causing the print head to eject the ink while causing the main scanning unit to perform the main scanning; and conveying processing of causing the conveyor to perform the conveyance. The control device is configured to execute: selection processing of selecting one of first processing and second processing for printing an $N^{th}$ band area, which is a band area extending in the second direction on a target image of one page and is a printing target of $N^{th}$ partial printing, when the $N^{th}$ band area includes a blank pixel line extending in the second direction, N being an integer equal to or greater than 1, the first processing being processing of causing the print execution unit to print the entire $N^{th}$ band area by executing the $N^{th}$ partial printing, and the second processing being processing of causing the print execution unit to print a pre-stage part, which is a part located at a position shifted toward the first direction with respect to the blank pixel line, of the $N^{th}$ band area by executing the $N^{th}$ partial printing and being processing of causing the print execution unit to print a post-stage part, which is a part located at a position shifted toward a printing direction opposite to the first direction with respect to the blank pixel line by executing $N+1^{th}$ partial printing; and execution processing of executing the one of the first processing and the second processing which is selected in the selection processing. In the selection processing, the control device is configured to: select the second processing when a total count condition is satisfied, the total count condition indicating that a total count of the partial printings for printing of the entire target image in a case in which the second processing is assumed to be executed is equal to or smaller than a total count of the partial printings for printing of the entire target image in a case in which the first processing is assumed to be executed; and select the first processing when the total count condition is not satisfied.

According to the configuration, when the total count condition is satisfied, the second processing is executed, so that the boundary between the band area by the $N^{th}$ partial printing and the band area by the $N+1^{th}$ partial printing is formed by the blank pixel line. Therefore, it is possible to suppress the boundary between the band areas from being noticed without an increase in printing time.

In the meantime, the technology of the present disclosure can be implemented in a variety of forms, such as a control method and a control device of the print execution unit, a printing method, a printing apparatus, a computer program for implementing functions of the method or apparatus, a recording medium (for example, a non-transitory recording medium) having the computer program recorded thereon, and the like.

DETAILED DESCRIPTION

The present disclosure provides technology capable of suppressing a boundary between two adjacent band areas from being noticed without an increase in printing time.

A. First Embodiment

A-1. Apparatus Configuration

Figure 1:
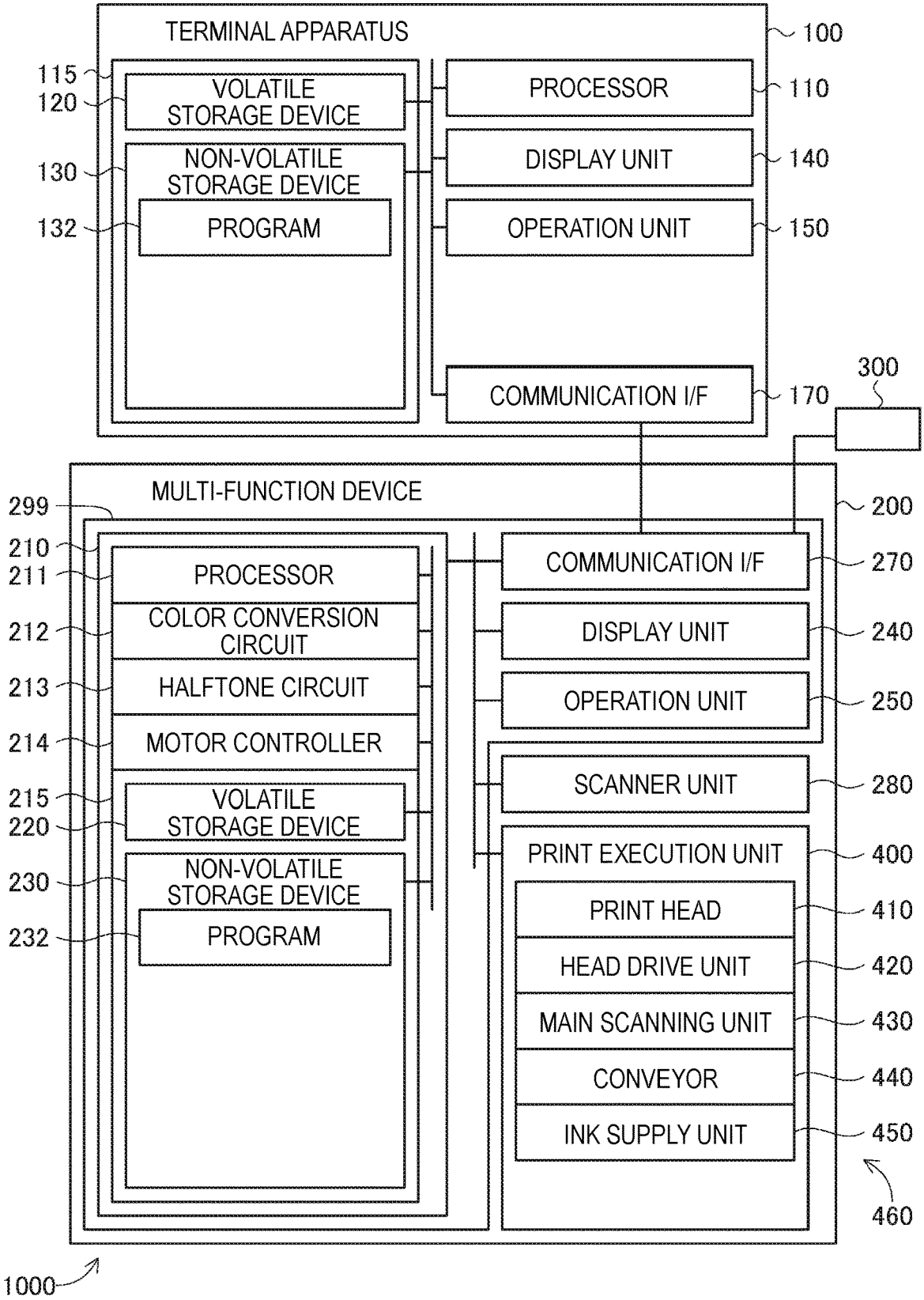
FIG. 1 illustrates an image processing system 1000 of an embodiment.

FIG. 1 illustrates an image processing system 1000 of an embodiment. The image processing system 1000 includes a terminal apparatus 100, and a multi-function device 200 connected to the terminal apparatus 100. As described later, the multi-function device 200 includes a scanner unit 280 configured to read a target such as a document, a print execution unit 400 configured to print an image, and a control device 299 configured to control the entire multi-function device 200.

The terminal apparatus 100 is a personal computer (for example, a desktop computer, a tablet computer and the like). The terminal apparatus 100 includes a processor 110, a storage device 115, a display unit 140 configured to display an image, an operation unit 150 configured to receive a user's operation, and a communication interface 170, which are connected each other via a bus. The storage device 115 includes a volatile storage device 120, and a non-volatile storage device 130.

The processor 110 is a device configured to perform data processing, and is, for example, a CPU. The volatile storage device 120 is, for example, a DRAM, and the non-volatile storage device 130 is, for example, a flash memory. In the non-volatile storage device 130, a program 132 is stored. The processor 110 is configured to execute the program 132, thereby implementing diverse functions. The functions that are implemented by the program 132 will be described in detail later. The processor 110 is configured to temporarily store a variety of intermediate data, which are used when executing the program 132, in the storage device 115 (for example, any one of the volatile storage device 120 and the non-volatile storage device 130). In the present embodiment, the program 132 is included in a device driver provided by a manufacture of the multi-function device 200.

The display unit 140 is a device configured to display an image, and is, for example, a liquid crystal monitor. Instead, other types of devices configured to display an image, such as an LED display, an organic EL display and the like, may also be adopted. The operation unit 150 is a device configured to receive a user's operation, and is, for example, a touch panel superimposed on the display unit 140. Instead, other types of devices to be operated by the user, such as a button, a lever and the like, may also be adopted. The user can operate the operation unit 150 to input diverse instructions to the terminal apparatus 100.

The communication interface 170 is an interface (for example, a USB interface, a wired LAN interface, and a wireless interface of IEEE 802.11) for performing communication with other devices. The communication interface 170 is connected to the multi-function device 200.

The terminal apparatus 100 is configured to drive the multi-function device 200, thereby causing the multi-function device 200 to print an image, in response to a user's instruction.

The multi-function device 200 includes a control device 299, a scanner unit 280, and a print execution unit 400. The control device 299 includes a data processing device 210, a display unit 240 configured to display an image, an operation unit 250 configured to receive a user's operation, and a communication interface 270, which are connected each other via a bus.

The data processing device 210 is an electric circuit configured to execute a variety of data processing. The data processing device 210 includes a processor 211, a color conversion circuit 212, a halftone circuit 213, a motor controller 214, and a storage device 215. The storage device 215 includes a volatile storage device 220, and a non-volatile storage device 230. The data processing device 210 is configured using an ASIC (Application Specific Integrated Circuit), for example.

The processor 211 is a device configured to perform data processing in accordance with a program, and is, for example, a CPU. The processor 110 is configured to execute a program 232 stored in the non-volatile storage device 230, thereby implementing diverse functions (which will be described in detail later). In the present embodiment, the program 232 is stored in advance in the non-volatile storage device 230 by the manufacturer of the multi-function device 200, as firmware.

The color conversion circuit 212 is an electric circuit configured to execute color conversion processing. The halftone circuit 213 is an electric circuit configured to execute halftone processing. The motor controller 214 is an electric circuit configured to control the print execution unit 400 (specifically, a motor and the like). At least one (for example, the motor controller 214) of the electric circuits 212, 213 and 214 may be configured using an FPGA (field-programmable gate array). The volatile storage device 220 is, for example, a DRAM, and the non-volatile storage device 230 is, for example, a flash memory.

The processor 211, the color conversion circuit 212, the halftone circuit 213 and the motor controller 214 are configured to temporarily store a variety of intermediate data, which are used for data processing, in the storage device (for example, any one of the volatile storage device 220 and the non-volatile storage device 230).

The display unit 240 is a device configured to display an image, and is, for example, a liquid crystal monitor. Instead, other types of devices configured to display an image, such as an LED display, an organic EL display and the like, may also be adopted. The operation unit 250 is a device configured to receive a user's operation, and is, for example, a touch panel superimposed on the display unit 240. Instead, other types of devices to be operated by the user, such as a button, a lever and the like, may also be adopted. The user can operate the operation unit 250 to input diverse instructions to the multi-function device 200.

The scanner unit 280 is configured to optically read a target such as a document by using a photoelectric conversion element such as a CCD, a CMOS and the like, thereby generating scan data indicative of a read image (referred to as "scan image"). The scan data is, for example, bitmap data of RGB indicative of a color scan image.

The print execution unit 400 is a device configured to print an image on a sheet (an example of a printing medium). In the present embodiment, the print execution unit 400 includes a print head 410 (also simply referred to as "head 410"), a head drive unit 420, a main scanning unit 430, a conveyor 440, and an ink supply unit 450. Although described in detail later, the print execution unit 400 is an inkjet-type printing apparatus configured to use each ink of cyan C, magenta M, yellow Y and black K. In the meantime, a useable combination of a plurality of types of inks is not limited to CMYK, and other diverse combinations (for example, cyan C, magenta M and yellow Y) can also be adopted.

The communication interface 270 is an interface (for example, a USB interface, a wired LAN interface, and a wireless interface of IEEE 802.11) for performing communication with other devices. The communication interface 270 is connected to the terminal apparatus 100. Also, the communication interface 270 can be connected to other types of devices such as a portable storage device 300, for example, a USB flash drive.

The multi-function device 200 can generate print data by using image data selected by the user, and cause the print execution unit 400 to print an image by using the generated print data. The user can select scan data or image data stored in an external device (for example, the portable storage device 300 that is connected to the communication interface 270). Also, the multi-function device 200 can cause the print execution unit 400 to print an image by using print data supplied from another apparatus (for example, the terminal apparatus 100) with which communication can be performed via the communication interface 270.

Figure 2:
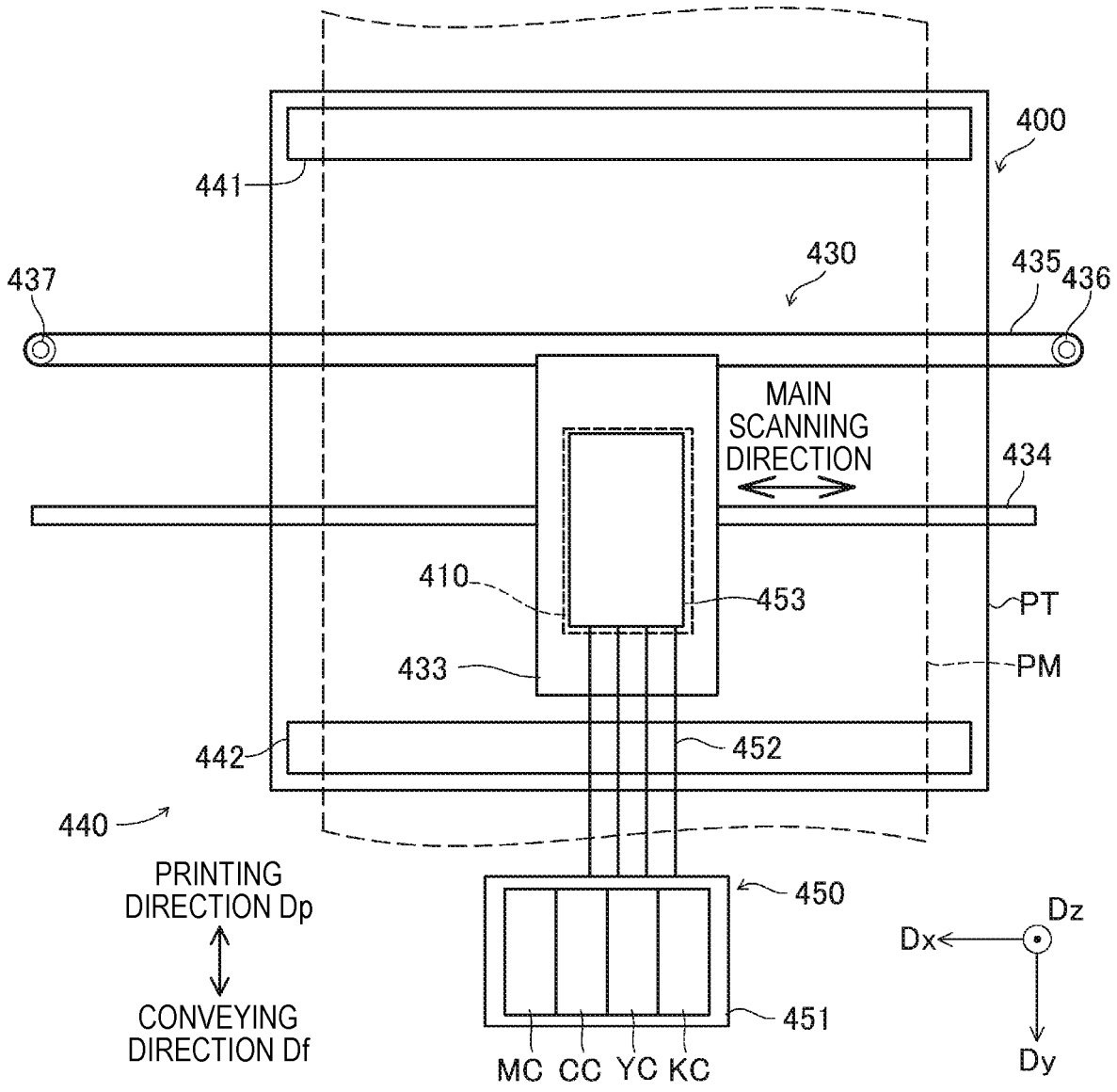
FIG. 2 is a schematic view of a print execution unit 400.

FIG. 2 is a schematic view of the print execution unit 400. The main scanning unit 430 includes a carriage 433, a slide shaft 434, a belt 435, and a plurality of pulleys 436 and 437. The carriage 433 is configured to mount thereon the print head 410. The slide shaft 434 is configured to hold the carriage 433 to be reciprocally moveable in a main scanning direction (a direction parallel to a Dx axis, in FIG. 2). The belt 435 is wound on the pulleys 436 and 437, and a part thereof is fixed to the carriage 433. The pulley 436 is rotated by power of a main scanning motor (not shown). When the main scanning motor rotates the pulley 436, the carriage 433 moves along the slide shaft 434. Thereby, main scanning of reciprocally moving the print head 410 relative to the sheet PM in the main scanning direction is implemented.

The conveyor 440 is configured to convey the sheet PM relative to the print head 410 in a conveying direction Df perpendicular to the main scanning direction while holding the sheet PM. The conveying direction Df is the same as the +Dy direction. Herein, an upstream side (−Df side) in the conveying direction Df is simply referred to as "upstream side", and a downstream side (+Df side) in the conveying direction Df is simply referred to as "downstream side". The conveyor 440 includes a platen PT arranged in a position facing a surface of the print head 410, from which ink is to be ejected, and configured to support the sheet PM, a pair of upstream rollers 441 and a pair of downstream rollers 442 each of which is configured to hold the sheet PM disposed on the platen PT, and a motor (not shown) configured to drive the rollers 441 and 442. The pair of upstream rollers 441 is arranged upstream of the print head 410, and the pair of downstream rollers 442 is arranged downstream of the print head 410. The sheet PM is fed from a sheet tray (not shown) to the conveyor 440 by a feeder roller (not shown). The sheet PM fed to the conveyor 440 is sandwiched between the pair of upstream rollers 441, and is conveyed downstream by the pair of upstream rollers 441 while the sheet PM is supported by the platen PT. The conveyed sheet PM is sandwiched between the pair of downstream rollers 442, and is conveyed downstream by the pair of downstream rollers 442 while the sheet PM is supported by the platen PT. The conveyor 440 is configured to drive the rollers 441 and 442 by power of the motor, thereby conveying the sheet PM in the conveying direction Df. Hereinbelow, the processing of moving the sheet PM in the conveying direction Df is also referred to as "sub-scanning" or "conveying processing". The conveying direction Df is also referred to as "sub-scanning direction Df".

The ink supply unit 450 is configured to supply ink to the print head 410. The ink supply unit 450 includes a cartridge mounting unit 451, tubes 452, and a buffer tank 453. A plurality of ink cartridges KC, YC, CC, MC in which inks are accommodated is detachably mounted to the cartridge mounting unit 451, and the inks are supplied from the ink cartridges. The buffer tank 453 is arranged above the print head 410 mounted to the carriage 433, and is configured to temporarily accommodate therein each ink of CMYK to be supplied to the print head 410. The tube 452 is a flexible tube configured to interconnect the cartridge mounting unit 451 and the buffer tank 453 and becoming a flow path of the ink. The ink in each ink cartridge is supplied to the print head 410 through the cartridge mounting unit 451, the tube 452 and the buffer tank 453. The buffer tank 453 is provided with a filter (not shown) for removing foreign matters mixed in the ink.

Figure 3:
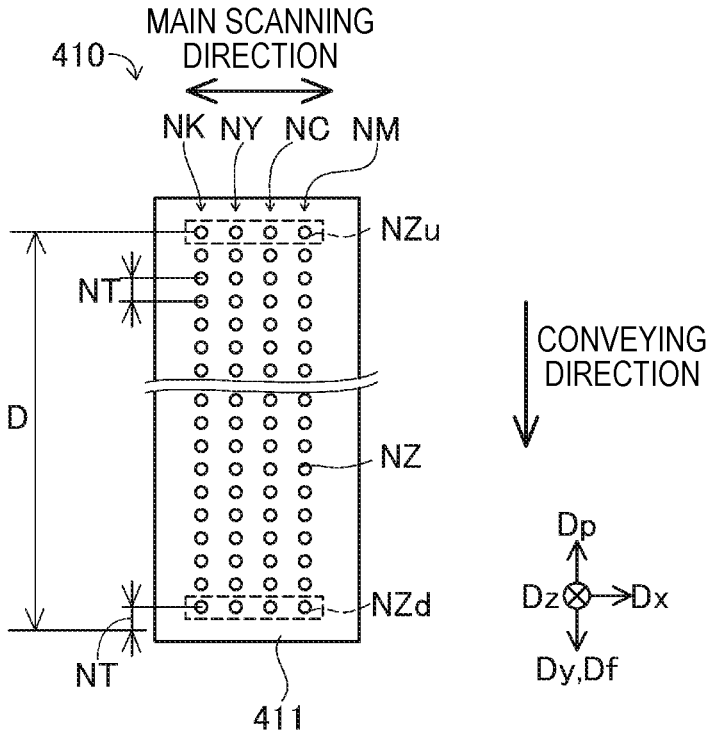
FIG. 3 depicts a configuration of a print head 410.

FIG. 3 depicts a configuration of the print head 410, as seen from a −Dz side. As shown in FIG. 2, the Dz direction is a direction facing from the platen PT toward the head 410 so as to be perpendicular to the two directions Dx and Dy. A nozzle formation surface 411 of the print head 410 shown in FIG. 3 is a surface facing the sheet PM to be conveyed by the conveyor 440 shown in FIG. 2. The nozzle formation surface 411 is formed with a plurality of nozzle groups each consisting of a plurality of nozzles NZ, i.e., nozzle groups NK, NY, NC, NM for ejecting the respective inks of K, Y, C and M. Each nozzle group includes a plurality of nozzles NZ. The plurality of nozzles NZ of one nozzle group has positions different from each other in the conveying direction Df, and is aligned with predetermined nozzle intervals NT in the conveying direction Df. The nozzle interval NT is a distance in the conveying direction Df between two nozzles NZ, which are adjacent to each other in the conveying direction Df, of the plurality of nozzles NZ. A nozzle NZ, which is located on the most upstream side (−Dy side), of the nozzles configuring the nozzle group is referred to as the most upstream nozzle NZu. Also, a nozzle NZ, which is located on the most downstream side (+Dy side), of the nozzles is referred to as the most downstream nozzle NZd. A length obtained by adding the nozzle interval NT to a length in the conveying direction Df from the most upstream nozzle NZu to the most downstream nozzle NZd is referred to as "nozzle length D".

Positions of the nozzle groups NK, NY, NC and NM in the main scanning direction are different, and positions thereof in the sub-scanning direction overlap each other. In the example of FIG. 3, the nozzle groups NK, NY, NC and NM are aligned in corresponding order in the +Dx direction.

Each nozzle NZ is connected to the buffer tank 453 shown in FIG. 2 through an ink flow path (not shown) formed in the print head 410. Each ink flow path is provided with an actuator (a piezo element, a heater, for example, but not shown) for ejecting the ink.

The head drive unit 420 shown in FIG. 1 includes an electric circuit configured to drive each actuator in the print head 410 during the main scanning by the main scanning unit 430. Thereby, the inks are ejected from the nozzles NZ of the print head 410 onto the sheet PM, so that dots are formed. In this way, the print head 410, the head drive unit 420 and the main scanning unit 430 are configured to form an image on the sheet PM by using the inks. Hereinbelow, the print head 410, the head drive unit 420 and the main scanning unit 430 are collectively referred to as an image forming unit 460.

A-2. Outline of Printing

In the present embodiment, the multi-function device 200 is configured to print an image on the sheet PM by repetitively executing partial printing of causing the print head 410 to eject the inks to form dots on the sheet PM while causing the main scanning unit 430 to perform the main scanning, and sub-scanning (conveyance of the sheet PM) by the conveyor 440.

Figure 4A:
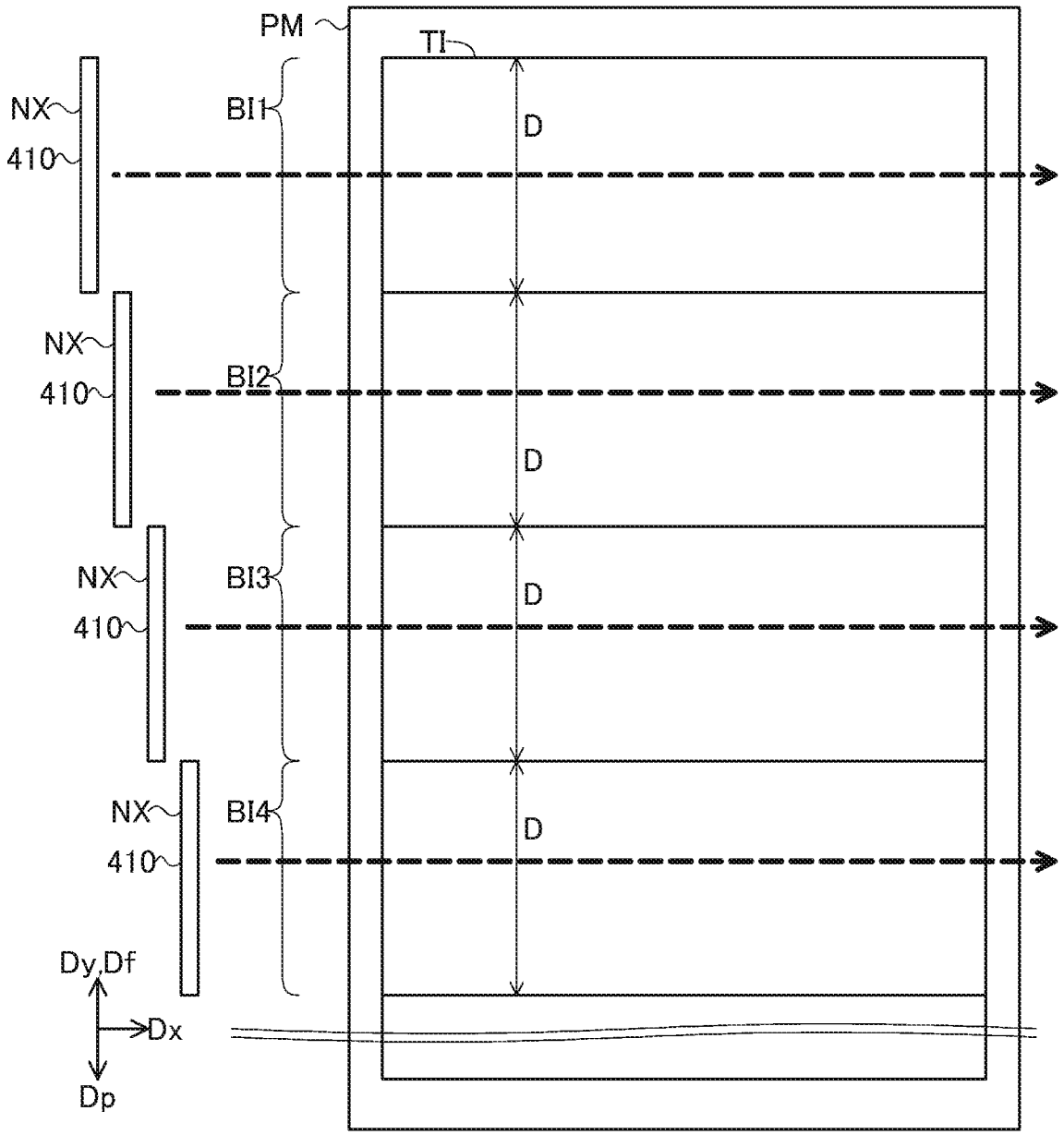
FIG. 4A depicts an example of operations of the print execution unit 400.

FIG. 4A illustrates an example of operations of the print execution unit 400. In FIG. 4A, a target image TI to be printed on the sheet PM is shown. In FIG. 4A, the +Dy direction is the conveying direction Df (i.e., the sub-scanning direction) of the sheet PM. On the target image TI, a plurality of band areas (including band areas BI1 to BI4) aligned in the −Dy direction (more generally, in the sub-scanning direction) is arranged. Each band area has a rectangular shape extending in the main scanning direction. Here, the main scanning direction is a direction parallel to the Dx direction. In the present embodiment, each band area indicates an area that can be printed by single partial printing. Each band area extends from an end on a −Dx side to an end on a +Dx side of the target image TI. On a left side of each of the band areas BI1 to BI4, the simplified nozzle group NX of the print head 410 for printing an image of the band area is shown. The nozzle group NX is representative of the nozzle groups NC, NM, MY and NK of FIG. 3. A width of each band area in the sub-scanning direction is preset, and is the same as the nozzle length D shown in FIG. 3, in the present embodiment. Also, in the present embodiment, an advancing direction for printing in each band area is the +Dx direction. That is, the advancing direction is the moving direction of the print head 410. Hereinbelow, the single partial printing is also referred to as "pass processing" or simply "pass". In the meantime, as the advancing direction for printing in each band area, both the +Dx direction and the −Dx direction may also be used.

Images in the plurality of band areas are printed one by one sequentially from an image in the band area at an end of the target image TI on the conveying direction Df side toward the −Df direction. Thereby, the entire target image TI is printed. Hereinbelow, an opposite direction to the conveying direction Df is also referred to as "printing direction Dp".

In the present embodiment, two band areas adjacent to each other are adjacent to each other without overlapping each other. Instead, the two band areas adjacent to each other may partially overlap each other. An area in which the two band areas overlap each other is printed in a distributed manner by two partial printings.

A-3. Printing Processing

Figure 5:
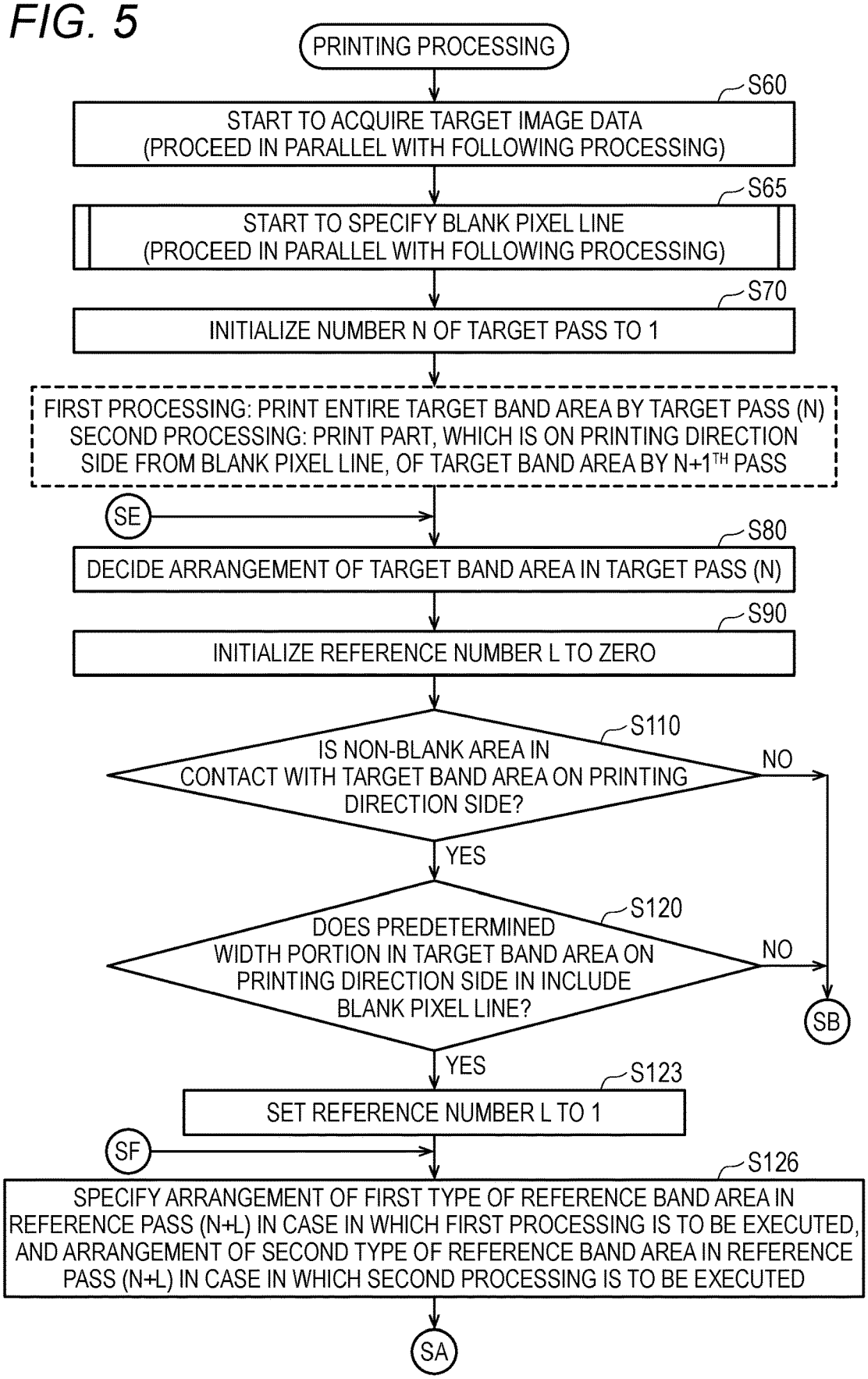
FIG. 5 is a flowchart depicting an example of printing processing.
Figure 6:
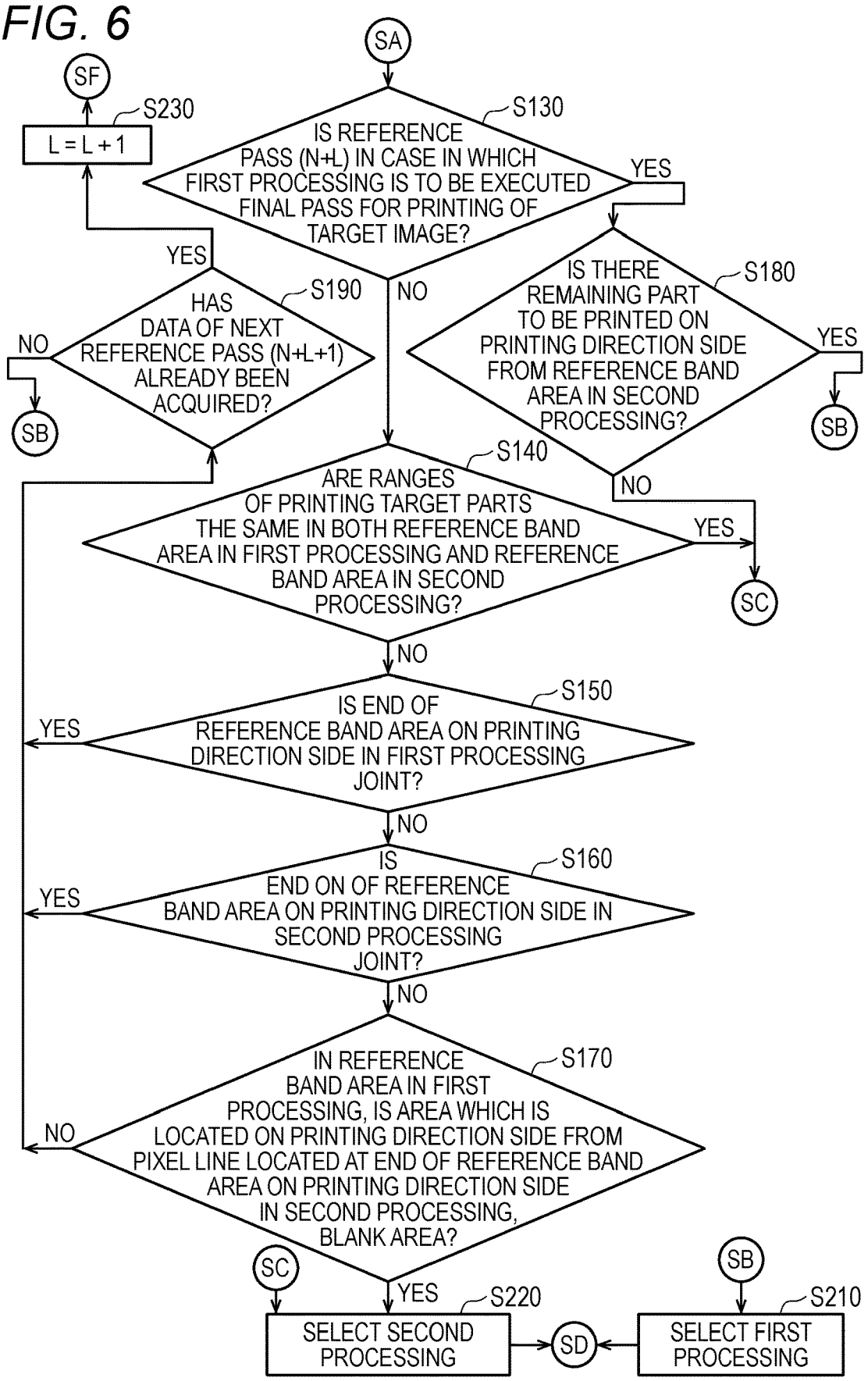
FIG. 6 is a flowchart depicting an example of the printing processing.
Figure 7:
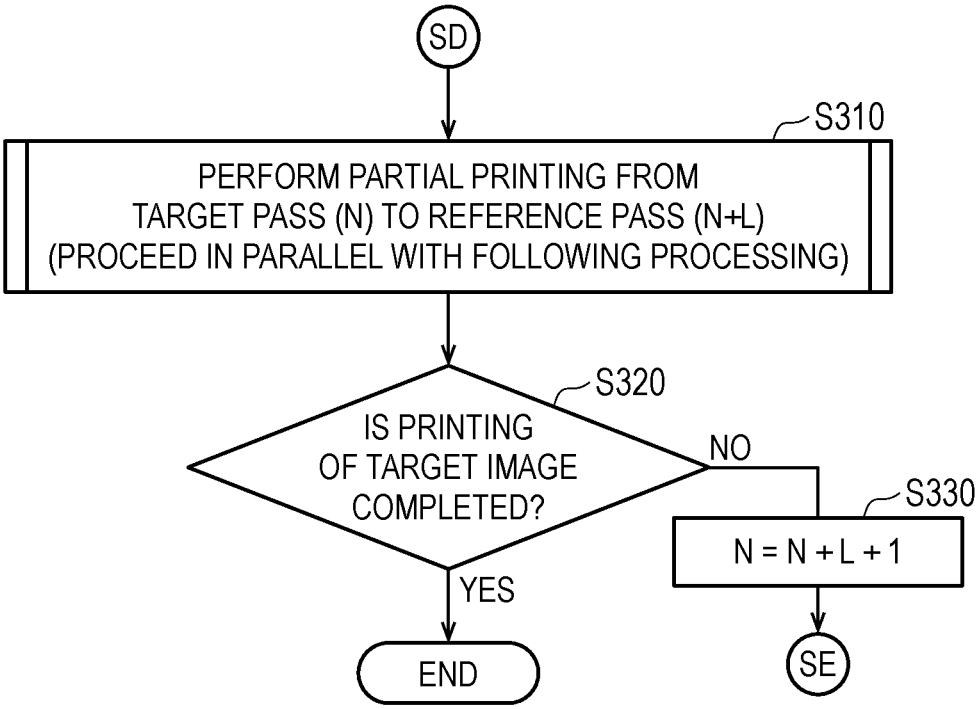
FIG. 7 is a flowchart depicting an example of the printing processing.

FIGS. 5 to 7 are flowcharts depicting an example of printing processing. FIG. 6 continues to FIG. 5, and FIG. 7 continues to FIG. 6. The multi-function device 200 starts the printing processing, in response to a printing instruction. A method of supplying the printing instruction to the multi-function device 200 may be any method. In the present embodiment, the user operates the operation unit 250 shown in FIG. 1 to input the printing instruction. The printing instruction includes information for designating image data for printing. As the image data for printing, diverse types of data may be designated. Hereinbelow, it is assumed that JPEG data stored in the portable storage device 300 is designated.

In S60, the processor 211 of the multi-function device 200 starts to acquire target image data, in response to the printing instruction. The target image data is image data of a target image, which is a printing target image. In the present embodiment, as the target image data, bitmap data is used. Also, it is assumed that a pixel value of each pixel of the target image data is represented by a gradation value of R (red), G (green) and B (blue) of 256 gradations from 0 to 255. Hereinbelow, a color space of the target image data is also referred to as "input color space". In a case in which the image data designated by the printing instruction is JPEG data, the processor 211 develops the JPEG data to acquire the target image data. In a case in which a format of the image data designated by the printing instruction is different from the bitmap format (for example, an EMF (Enhanced Meta File) format), the processor 211 uses bitmap data generated as a result of converting (for example, rasterizing) the data format, as the target image data. Also, in a case in which a resolution (i.e., a pixel density) of the bitmap data is different from a preset resolution for printing, the processor 211 executes resolution conversion processing to generate the target image data having a resolution for printing. Hereinbelow, a pixel having a resolution for printing is referred to as "print pixel".

In the present embodiment, the processor 211 starts another processing of the printing processing before the acquisition of the target image data is completed. In the embodiment of FIG. 5, the processor 211 starts processing of S65 before the acquisition of the target image data is completed. In this way, the acquisition of the target image data is executed in parallel with another processing of the printing processing.

Figure 8:
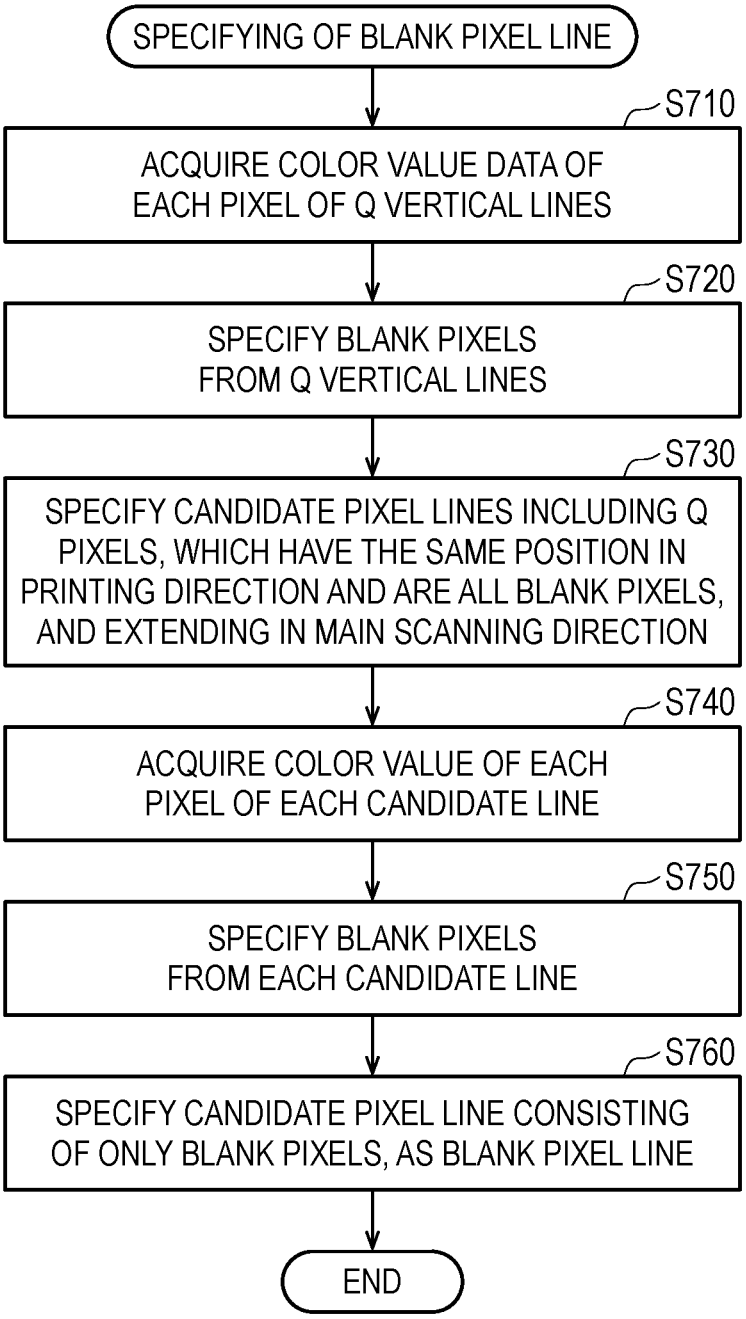
FIG. 8 is a flowchart depicting an example of processing of specifying a blank pixel line.

In S65, the processor 211 starts processing of specifying a blank pixel line in the target image. FIG. 8 is a flowchart depicting examples of processing of specifying a blank pixel line. In this processing, the processor 211 specifies a candidate pixel line by using a plurality of pixel rows included in the target image, and determines whether the candidate pixel line is a blank pixel line by using a plurality of pixels of the candidate pixel line.

Figure 9:
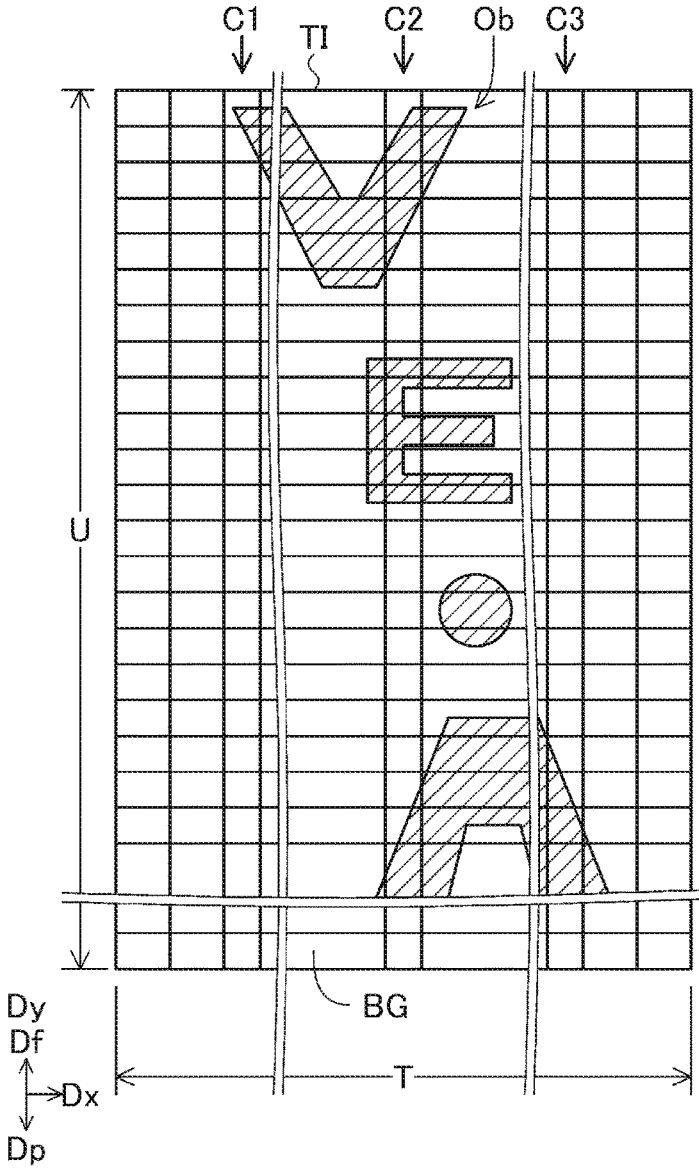
FIG. 9 is a schematic view depicting examples of a target image TI and a candidate pixel line.

FIG. 9 is a schematic view depicting an example of the target image TI and the candidate pixel line. An example of the target image TI is shown on the left side of FIG. 9. The target image TI includes diverse objects Ob such as a character, a figure and the like, and a background BG. In FIG. 9, the objects Ob are hatched. The target image TI is represented by a plurality of pixels aligned in a lattice shape in the Dx direction and in the Dy direction (not shown). Hereinbelow, a pixel line formed by a plurality of pixels aligned in the main scanning direction (a direction parallel to the Dx direction) is referred to as "pixel row". A total count of pixel rows included in the target image TI is denoted with U. Also, a pixel line formed by a plurality of pixels aligned in the sub-scanning direction Dy is referred to as "pixel column" A total count of pixel columns included in the target image TI is denoted with T. Also, a position of a pixel in the Dx direction in the target image TI is referred to as "column number". Column numbers are allotted in order from "1" so as to be aligned in ascending order in the Dx direction. Also, a position of a pixel in the −Dy direction in the target image TI is referred to as "row number". Row numbers are allotted in order from "1" so as to be aligned in ascending order in the −Dy direction.

In S710 of FIG. 8, the processor 211 refers to the target image data, and acquires color value data of each pixel of a Q pixel column, which is a part of the T pixel columns included in the target image TI. Q is an integer equal to or greater than 1. Hereinbelow, the Q pixel column is referred to as "target pixel column", or "target pixel line". In the present embodiment, it is assumed that three preset target pixel columns are used. That is, Q is equal to 3 (Q=3). In FIG. 9, the pixel columns C1, C2 and C3 are the target pixel columns.

In S720 of FIG. 8, the processor 211 specifies blank pixels from the plurality of pixels of the Q target pixel columns. The blank pixel is a pixel to which the ink is not to be ejected. In the present embodiment, when the color value data of a pixel indicates the brightest white, the processor 211 determines that the pixel is a blank pixel. In the present embodiment, a color indicated by R=G=B=255 is the brightest white. In the target image TI of FIG. 9, the color value data of pixels indicative of the background BG indicates the brightest white, and the color value data of pixels indicative of the object Ob indicates a color different from the brightest white. Hereinbelow, a pixel indicative of a color different from the brightest white is also referred to as "non-blank pixel". The processor 211 determines for each of the plurality of pixels of the Q target pixel columns whether the pixel is a blank pixel. Then, the processor 211 generates blank pixel flag data, which indicates a result of the determination for each pixel, and stores temporarily the generated blank pixel flag data in the storage device 215 (for example, the non-volatile storage device 230).

In Table TB1 on a right side of FIG. 9, an example of a relation between a row number j and a blank pixel flag Fl indicated by the blank pixel flag data is shown. A flag Fl "1" indicates a "blank pixel" and a flag Fl "zero" indicates a "non-blank pixel". In Table TB1, the blank pixel flags Fl of each of the plurality of pixels of the three target pixel columns C1, C2 and C3 are shown. The row number j is aligned in order from "1" from top to bottom in FIG. 9. In Table TB1, vertical positions of the row number j and the blank pixel flag Fl correspond to a vertical position (i.e., a position in the conveying direction Df) of a pixel having the same row number in the target image TI on the left side. In FIG. 9, for description, a width of one pixel line (and a size of one pixel) in the target image TI is largely shown. Actually, a size of one pixel in the target image TI is smaller.

As shown in Table TB1, the blank pixel flag Fl of a pixel, which indicates the background BG, of the respective pixels of the three target pixel columns C1, C2 and C3 is set to "1", and the blank pixel flag Fl of a pixel indicative of the object Ob is set to "0".

In S730 of FIG. 8, the processor 211 refers to the blank pixel flags Fl, and searches for a pixel row of which Q pixels having the same row number are all the blank pixels. In the example of FIG. 9, the blank pixel flags Fl of the three pixels of the pixel row having the row number "6" are all "1 (blank pixel)". The processor 211 specifies the detected pixel row, as the candidate pixel line. The processor 211 determines for each pixel row of the U pixel rows whether the pixel row is the candidate pixel row. Then, the processor 211 generates candidate flag data, which indicates a result of the determination for each pixel row, and stores temporarily the candidate flag data in the storage device 215 (for example, the non-volatile storage device 230). In Table TB1 of FIG. 9, a candidate flag Fc indicates a result of the determination indicated by the candidate flag data. The candidate flag Fc "1" indicates a candidate pixel row, and the candidate flag Fc "zero" indicates a non-candidate pixel row. Hereinbelow, the candidate pixel row is also referred to as "candidate line".

In S740 of FIG. 8, the processor 211 refers to the target image data, and acquires the color value data of each of the plurality of pixels of each candidate line. In S750, the processor 211 specifies blank pixels from the plurality of pixels of each candidate line. In S760, the processor 211 specifies a candidate line consisting of only blank pixels, as a blank pixel line. The processor 211 determines for all the candidate lines whether the candidate line is a blank pixel line. Then, the processor 211 generates blank line flag data, which indicates a result of the determination for each candidate line, and stores temporarily the blank line flag data in the storage device 215 (for example, the non-volatile storage device 230). In Table TB1 of FIG. 9, a blank line flag Fr indicates a result of the determination indicated by the blank line flag data. The blank line flag Fr "1" indicates a blank pixel line, and the blank line flag Fr "zero" indicates a non-blank pixel line. The non-blank pixel line is a pixel line including one or more non-blank pixels. Thus, the processing of FIG. 8, i.e., the processing of S65 in FIG. 5 is over.

In the meantime, as described in S60 of FIG. 5, in the step of executing the processing of S65, a part of the target image data may not be acquired yet. The processor 211 executes the processing of FIG. 8 for a pixel row that can be determined by using the acquired part of the target image data. For example, when the target image data is gradually acquired part by part from an end of the target image TI of FIG. 9 on the conveying direction Df side toward the printing direction Dp, the processor 211 gradually determines whether the pixel row is a blank pixel line toward the printing direction Dp.

In the present embodiment, the processor 211 starts another processing of the printing processing before the determination for all the pixel rows in S65 is completed. In the embodiment of FIG. 5, the processor 211 starts processing of S70 even when the processing of S65 is not completed yet. In this way, the determination as to whether the pixel row is a blank pixel line is performed in parallel with another processing of the printing processing.

In S70, the processor 211 initializes a number N of a target pass, which is a processing target pass, to "1" (hereinbelow, referred to as "target number N"). Subsequently, when a target band area, which is a band area in the target pass, includes a blank pixel line, the processor 211 selects processing of printing the target band area from first processing and second processing. The first processing is processing of printing an entire target band area by the target pass. The second processing is processing of printing the target band area by two divided passes of the target pass and a next pass. In the below, this is described in detail.

In S80, the processor 211 decides arrangement of the target band area which is a band area in the target pass. As described in FIG. 4A, in the present embodiment, the processor 211 arranges sequentially the plurality of band areas one by one from an end of the target image TI on the conveying direction Df side toward the printing direction Dp. Usually, two band areas adjacent to each other are in contact with each other without a gap. However, in the present embodiment, in a case in which an end portion of a band area on the conveying direction Df side overlaps a blank band, the processor 211 arranges the band area in a position in which the blank band is skipped.

Figure 4B:
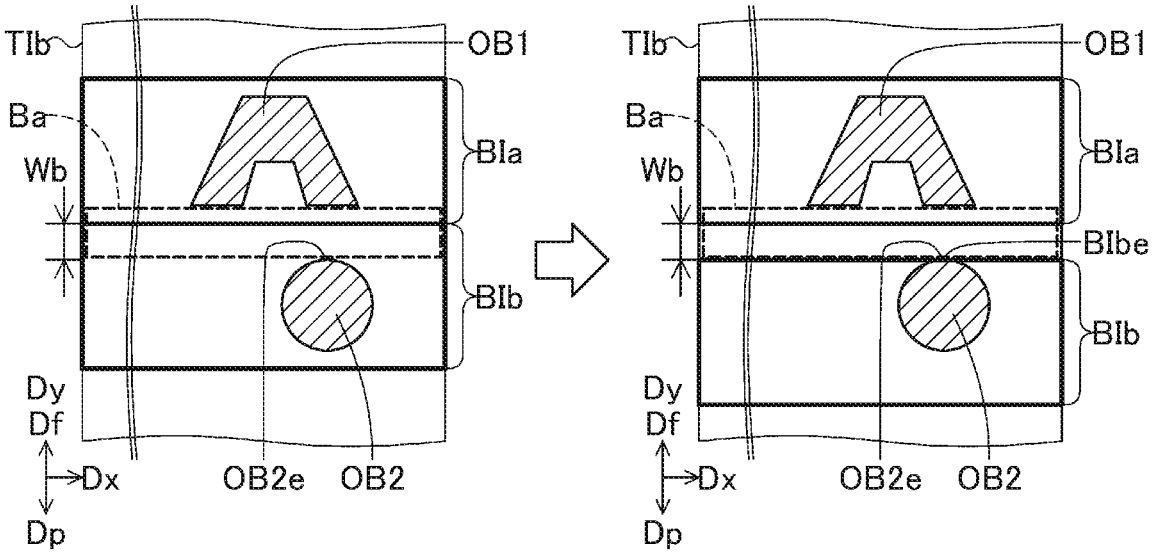
FIG. 4B depicts skipping of a blank band.

FIG. 4B illustrates skipping of the blank band. On a left side, usual arrangement of the two adjacent band areas BIa and BIb on the target image TIb is shown. The band areas BIa and BIb are in contact with each other, and are arranged in corresponding order in the printing direction Dp. The first band area BIa indicates a first object OB1, and the second band area BIb indicates a second object OB2. The objects OB1 and OB2 are arranged distant in the printing direction Dp. A blank band Ba is formed between the two objects OB1 and OB2. In the present embodiment, the blank band is an area in which one or more blank pixel lines continue and in which no dot is formed. An end portion of the second band area BIb on a side in the conveying direction Df overlaps the blank band Ba. In FIG. 4B, a width Wb is a width in the printing direction Dp of an overlapping portion of the second band area BIb and the blank band Ba.

When an end portion of the band area on a side in the conveying direction Df in the usual arrangement overlaps the blank band, like the second band area BIb, the processor 211 moves the band area in the printing direction Dp until the end portion of the band area on a side in the conveying direction Df overlaps the object. On a right side of FIG. 4B, the moved second band area BIb is shown. An end BIbe of the second band area BIb on a side in the conveying direction Df indicates an end OB2*e* of the second object OB2 on a side in the conveying direction Df. A moving amount of the second band area BIb is the same as the width Wb.

In this way, in the present embodiment, the processor 211 decides arrangement of the band areas in S80 of FIG. 5, in accordance with following conditions A and B. Condition A is that two adjacent band areas are arranged without a gap. Condition B is that, when an end portion of a band area on the conveying direction Df side overlaps a blank band, the band area is moved in the printing direction Dp. The moving amount is the same as a width of the blank band overlapping the band area.

In S90 of FIG. 5, the processor 211 initializes a reference number L to "zero". The reference number L is used so as to specify a number N+L of a pass of interest after the target pass. Hereinbelow, the pass of the number N+L is also referred to as a reference pass. As described later, "1" is add to the reference number L whenever processing in the reference pass is over.

In S110, the processor 211 determines whether a non-blank area is in contact with the target band area on the printing direction Dp side. The non-blank area is an area in which a blank pixel line is not included. When a blank pixel line is in contact with the target band area on the printing direction Dp side, a result of the determination in S110 is No. When a non-blank pixel line is in contact with the target band area on the printing direction Dp side, a result of the determination in S110 is Yes.

When a result of the determination in S110 is No, the processor 211 selects the first processing in S210 of FIG. 6 and proceeds to S310 of FIG. 7. In S310, the partial printing is performed in L+1 band areas from $N^{th}$ band area to $N+L^{th}$ band area.

Figure 10:
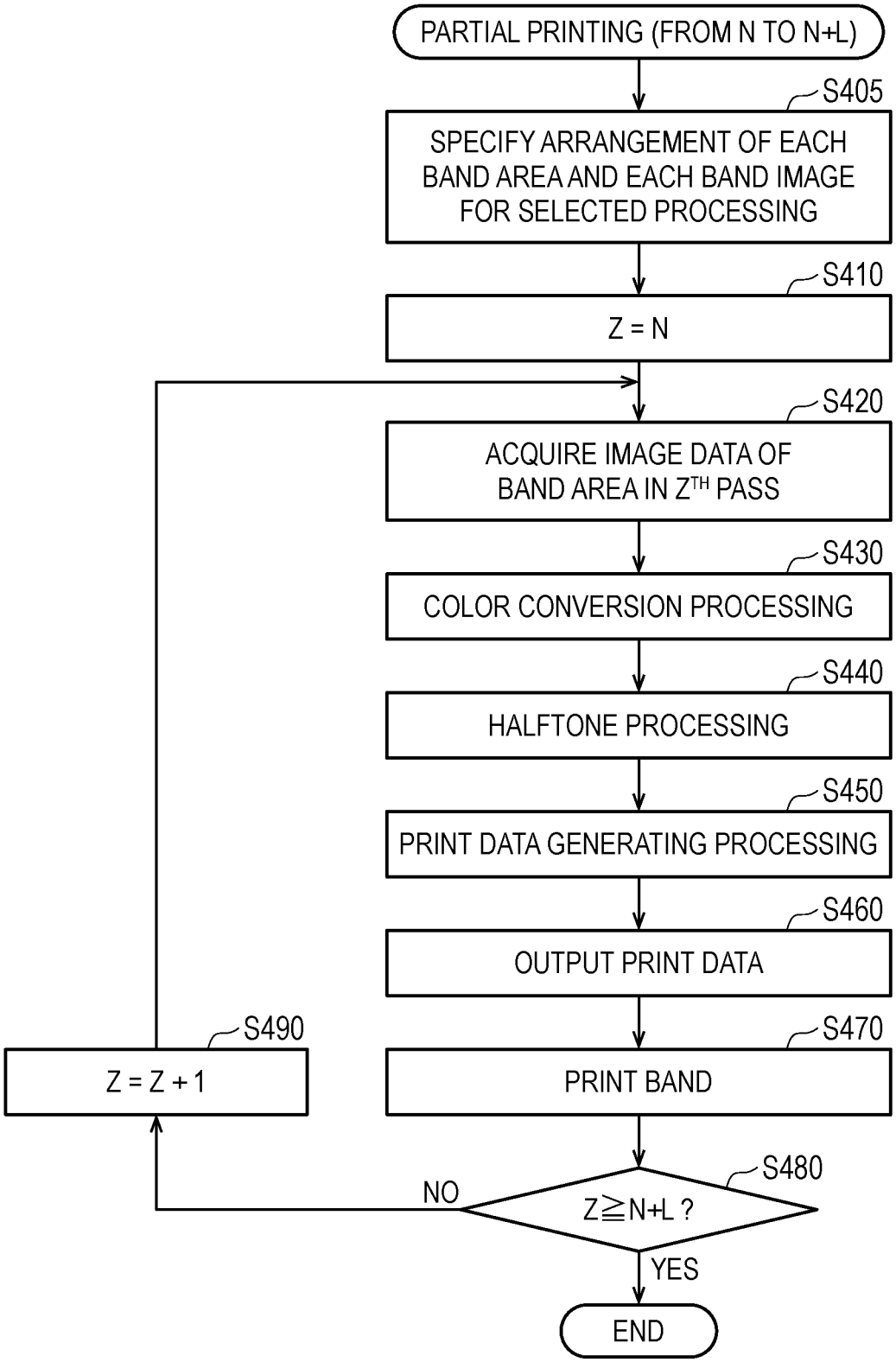
FIG. 10 is a flowchart depicting an example of partial printing.

FIG. 10 is a flowchart depicting an example of the partial printing in S310 of FIG. 7. In S405, the processor 211 specifies arrangement of each band area and each band image for processing selected in any one of S210 and S220 of FIG. 6. The band image is an image to be printed in the band area. When the first processing is selected in S210 of FIG. 6, each band area is printed by single partial printing. Therefore, the entire band area corresponds to the band image. A case in which the second processing is selected in S220 of FIG. 6 will be described later.

In S410, the processor 211 initializes a printing number Z to the target number N. The printing number Z is the number of current row partial printing (i.e., pass). In S420, the processor 211 refers to the target image data, and acquires image data (also referred to as "current row band data") of a band image in a $Z^{th}$ pass. The processor 211 supplies the acquired current row band data to the color conversion circuit 212 in FIG. 1.

In S430, the color conversion circuit 212 in FIG. 1 executes color conversion processing on the current row band data. The color conversion processing is processing of converting a color value (in the present embodiment, RGB values) of each pixel indicated by the current row band data into a color value (in the present embodiment, CMYK values) of an ink color space corresponding to colors of a plurality of types inks that can be used for printing. In the present embodiment, the color conversion circuit 212 executes the color conversion processing while referring to a color conversion profile (not shown). The color conversion profile is data indicative of a correspondence relation between a color value of the input color space, which is a color space of the target image data, and a color value of the ink color space. In the present embodiment, as the color conversion profile, a preset look-up table is used. The color conversion circuit 212 stores the color-converted current row band data in the storage device 215 (any one of the volatile storage device 220 and the non-volatile storage device 230).

In S440, the halftone circuit 213 in FIG. 1 executes halftone processing on the color-converted current row band data. In the present embodiment, the halftone processing is processing of using a dither matrix. By the halftone processing, dot data indicative of a formation state of dot is generated for each color component and for each print pixel. The halftone circuit 213 stores the generated dot data in the storage device 215 (any one of the volatile storage device 220 and the non-volatile storage device 230). The formation state of dot is a state of a dot to be formed by printing, and is, in the present embodiment, one of "there is no dot" and "there is a dot". Instead, the formation state of dot may be selected from three or more states (for example, "large dot", "medium dot", "small dot" and "there is no dot") including two or more states of "there are dots" in which dot sizes are different from each other. In any case, the dot data indicates a value corresponding to the formation state of dot.

In S450, the processor 211 generates partial printing data for printing of a $Z^{th}$ band image by using the dot data. The partial printing data is print data for single partial printing. The partial printing data includes information specifying print pixels for which ink dots are to be formed, and information indicative of a conveying amount of the sheet PM after partial printing.

In S460, the processor 211 outputs the partial printing data to the motor controller 214. In S470, the motor controller 214 controls the diverse motors (not shown) and the head drive unit 420 of the print execution unit 400, in accordance with the partial printing data. Thereby, single partial printing and conveyance of the sheet PM are performed. Thus, the $Z^{th}$ partial printing is completed.

In S480, the processor 211 determines whether the printing number Z is equal to or greater than N+L. In a case in which a $N+L^{th}$ partial printing is completed, a result of the determination in S480 is Yes. In this case, the processor 211 ends the processing of FIG. 10, i.e., the processing of S310 of FIG. 7. In a case in which the partial printing not processed yet remains, a result of the determination in S480 is No. In this case, the processor 211 updates the printing number Z to "Z+1" in S490, and proceeds to S420. Then, the processor 211 executes processing of next partial printing.

Meanwhile, in the present embodiment, the processor 211 starts another processing of the printing processing before all the $N^{th}$ to $N+L^{th}$ partial printings in S310 of FIG. 7 are completed. In the embodiment of FIG. 7, the processor 211 starts processing of S320 even when the processing of S310 has not been completed yet. In this way, the partial printing is executed in parallel with another processing of the printing processing.

In S320, the processor 211 determines whether the printing of the target image has been completed. When it is determined that the printing of the target image has been completed (S320: Yes), the processor 211 ends the printing processing. When it is determined that the printing of the target image has not been completed (S320: No), the processor 211 updates the target number N to "N+L+1" in S330, and proceeds to S80 of FIG. 5. Then, the processor 211 executes processing of a new target pass.

When a result of the determination in S110 of FIG. 5 is Yes, the processor 211 determines in S120 whether a blank pixel line is within a part of the target band area having a predetermined width on the printing direction Dp side. When the specifying of the blank pixel line in the target band area is not completed (S65), the processor 211 waits until the specifying of the blank pixel line is completed.

Figure 11:
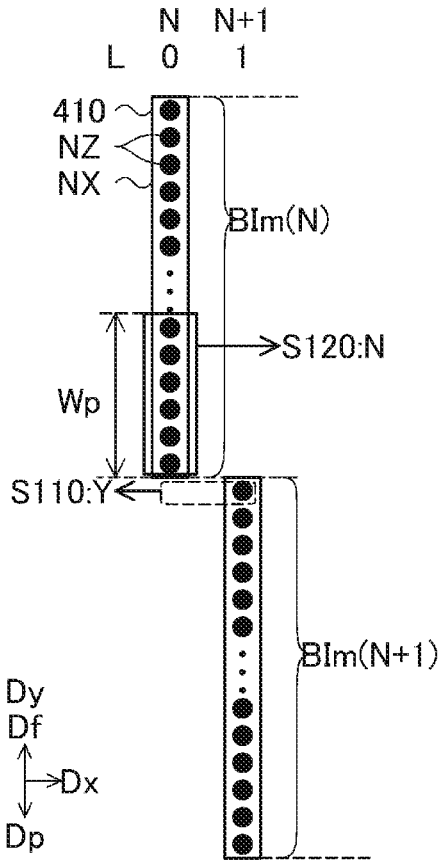
FIG. 11 depicts an example of arrangement of nozzle groups NX (and, band areas).

FIG. 11 illustrates an example of arrangement of the nozzle groups NX (and the band areas) in each of the $N^{th}$ partial printing and thereafter. In FIG. 11, the simplified nozzle groups NX similar to FIG. 4A are shown. In FIG. 11, the upward direction is the conveying direction Df, and the downward direction is the printing direction Dp. In FIG. 11, a plurality of nozzle groups NX corresponding to a plurality of reference numbers L (here, "0" and "1") is shown. The plurality of nozzle groups NX is aligned so that the reference number L increases rightward. In each of the nozzle groups NX, the plurality of nozzles NZ is shown. The black circle nozzles NZ indicate nozzles NZ (also referred to as "ejection nozzles") from which the ink is to be ejected in partial printing. The ejection nozzle corresponds to a non-blank pixel line.

A reference sign BIm denoted on the right side of each nozzle group NX indicates a band area. In a parenthesis next to the reference sign BIm, the number of the band area is shown. For example, a reference sign BIm(N+1) indicates a $N+1^{th}$ band area corresponding to $N+1^{th}$ partial printing. In FIG. 11, each of the band areas BIm(N) and BIm(N+1) is an area that can be printed using all the nozzles NZ of the corresponding nozzle group NX. In the meantime, the band areas BIm(N) and BIm(N+1) indicate the band areas in the first processing.

As shown, the nozzle NZ at an end of the nozzle group NX of the number N+1 on the conveying direction Df side is a black circle ejection nozzle. That is, a non-blank pixel line is in contact with the target band area BIm(N) on the printing direction Dp side. Therefore, a result of the determination in S110 of FIG. 5 is Yes.

In FIG. 11, a width Wp is a width that is used for the determination in S120 of FIG. 5. The width Wp is set in advance. The processor 211 refers to the blank line flag data generated in S65, and determines whether a blank pixel line is included within a range of the width Wp from an end of the target band area BIm(N) on the printing direction Dp side. The width Wp is set in advance such that the width Wp is smaller than the nozzle length D shown in FIG. 3. In the present embodiment, when a number of nozzles NZ (i.e., the nozzles NZ included within the range of the width Wp), which are set in advance and are at an end portion on the printing direction Dp side, of the plurality of nozzles NZ of the nozzle group NX include a nozzle corresponding to a blank pixel line, the processor 211 determines that a blank pixel line is included within the range of the width Wp. In the example of FIG. 11, since all the nozzles NZ within the width Wp correspond to the non-blank pixel lines, a result of the determination in S120 is No.

When a result of the determination in S120 is No, the processor 211 executes the same processing as the case in which a result of the determination in S110 is No.

Figure 12:
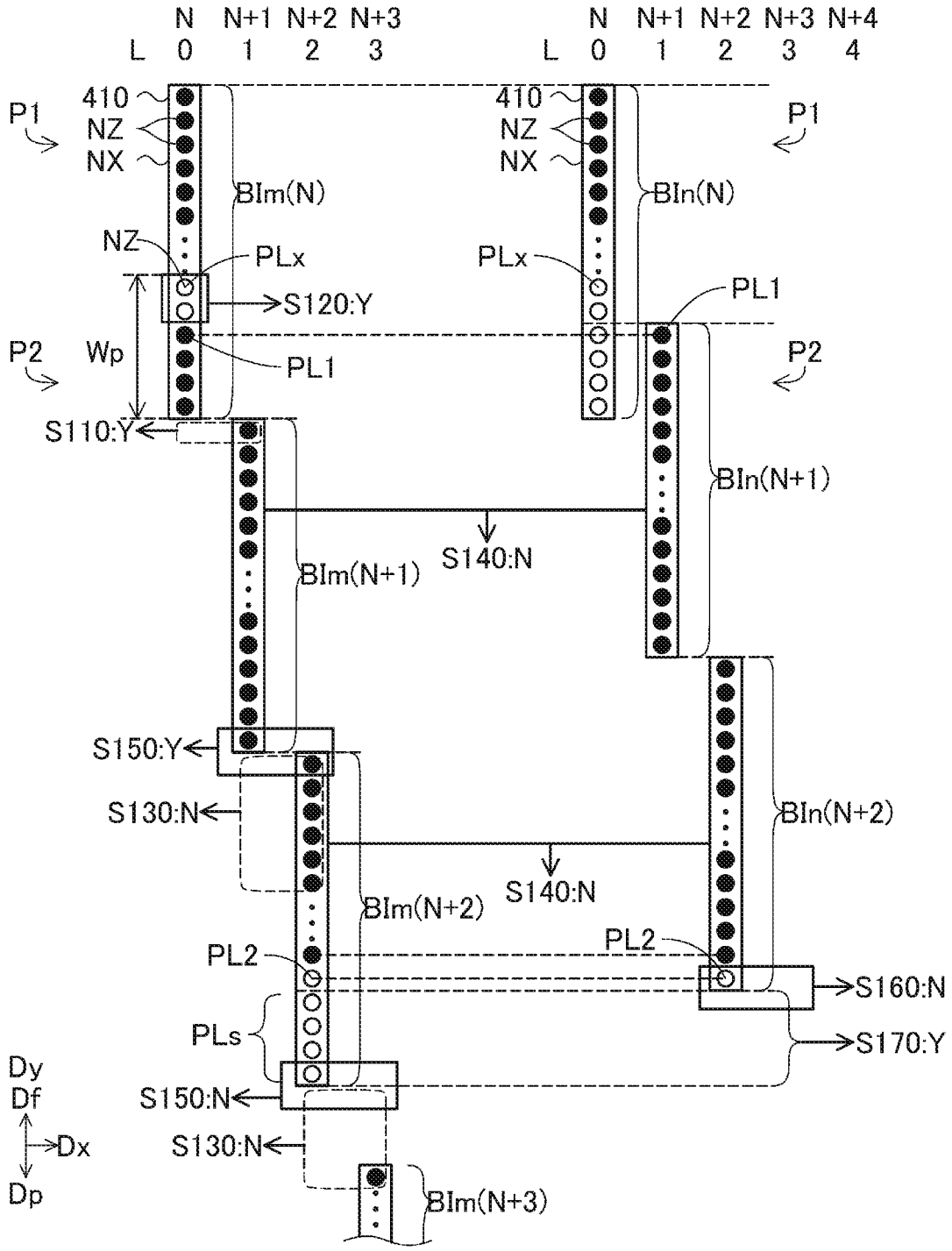
FIG. 12 depicts another example of arrangement of the nozzle groups NX (and, band areas)

FIG. 12 illustrates another example of the arrangement of the nozzle groups NX (and, the band areas). In FIG. 12, as with FIG. 11, a plurality of nozzle groups NX corresponding to a plurality of reference numbers L (here, 0 to 3) is shown. On the left side, the arrangement is shown in a case in which it is assumed that the first processing is to be executed, and on the right side, the arrangement is shown in a case in which it is assumed that the second processing is to be executed. Also, the white circle nozzles NZ indicate nozzles NZ (also referred to as "non-ejection nozzles") from which the ink should not be ejected in partial printing. The non-ejection nozzle corresponds to a blank pixel line. A reference sign "BIm" denoted on the left side indicates a band area in the first processing. A reference sign "BIn" denoted on the right side indicates a band area in the second processing. In a parenthesis next to each of the reference signs BIm and BIn, the number of the band area is shown. This also applies to the other drawings, which will be described later.

As shown on the left side, since a non-blank pixel line is in contact with the target band area BIm(N) on the printing direction Dp side, a result of the determination in S110 of FIG. 5 is Yes. Also, since the white circle non-ejection nozzles (i.e., blank pixel lines PLx) are included in the width Wp of the target band area BIm(N), a result of the determination in S110 of FIG. 5 is Yes.

In S123 of FIG. 5, the processor 211 sets the reference number L to "1". In S126, the processor 211 specifies arrangement of a $N+L^{th}$ band area in the case in which it is assumed that the first processing is to be executed, and arrangement of a $N+L^{th}$ band area in the case in which it is assumed that the second processing is to be executed.

On the left side of FIG. 12, the arrangement of band areas corresponding to the first processing is shown. The arrangement of the respective band areas is specified as follows. The processor 211 assumes that the entire target band area BIm(N) is to be printed by $N^{th}$ partial printing, and specifies the arrangement of each band area in accordance with the above-described conditions A and B. For example, the $N+1^{th}$ band area BIm(N+1) is arranged in a position adjacent to the target band area BIm(N) on the printing direction Dp side.

On the right side of FIG. 12, the arrangement of band areas corresponding to the second processing is shown. The arrangement of the respective band areas is specified as follows. The processor 211 assumes that a part of the target band area BIn(N), which is on the conveying direction Df side from the blank pixel line PLx within the range of the width Wp, is to be printed by $N^{th}$ partial printing. Also, the processor 211 assumes that a part of the target band area BIn(N), which is on the printing direction Dp side from the blank pixel line PLx, is to be printed by $N+1^{th}$ partial printing. Under the assumptions, the processor 211 specifies the arrangement of the $N+1^{th}$ band area BIn(N+1). In the present embodiment, the arrangement of the $N+1^{th}$ band area BIn(N+1) is decided so that a pixel line at an end of the N+1$^{th}$ band area BIn(N+1) on the conveying direction Df side is to be a pixel line PL1, which is at an end on the conveying direction Df side, of the non-blank pixel lines within the width Wp. The arrangement of band areas in N+2$^{th}$ partial printing and thereafter is specified in accordance with the conditions A and B.

In S130 of FIG. 6, the processor 211 determines whether the reference pass is a final pass for printing the target image, in the case in which it is assumed that the first processing is to be executed. In the example of FIG. 12, in a case of L=1, since the black circle ejection nozzle (i.e., the non-blank pixel line) is arranged on the printing direction Dp side from the reference band area BIm(N+1), the reference pass is not a final pass (S130: No).

When it is determined that the reference pass is not a final pass (S130: No), the processor 211 determines in S140 whether ranges of printing target parts in the reference band areas BIm(N+L) and BIn(N+L) are the same between the first processing and the second processing. The printing target part is a remaining part except the blank pixel line. The range of the printing target parts is a distribution range of non-blank pixel lines. When it is determined that the ranges of printing target parts are the same in the first processing and the second processing (S140: Yes), the processing proceeds to S220. In the example of FIG. 12, in the case of L=1, the non-blank pixel line PL1 included in the reference band area BIn(N+1) in the second processing is not included in the reference band area BIm(N+1) in the first processing. Therefore, the ranges of the printing target parts in the reference band areas BIm(N+L) and BIn(N+L) are not the same in the first processing and the second processing. As a result, a result of the determination in S140 is No.

When it is determined that the ranges of printing target parts are not the same in the first processing and the second processing (S140: No), the processor 211 determines in S150 whether an end of the reference band area on the printing direction Dp side is a joint of the target image, in the case in which it is assumed that the first processing is to be executed. When a non-blank pixel line is adjacent to the reference band area on the printing direction Dp side, a result of the determination in S150 is Yes. When a blank pixel line is adjacent to the reference band area on the printing direction Dp side, a result of the determination in S150 is No. In the example of FIG. 12, in the case of L=1, the black circle ejection nozzle (i.e., the non-blank pixel line) is adjacent to the reference band area BIm(N+1) on the printing direction Dp side in the first processing. Therefore, an end of the reference band area on the printing direction Dp side is a joint of the target image.

When it is determined that an end of the reference band area on the printing direction Dp side is a joint of the target image (S150: Yes), the processor 211 determines in S190 whether band data for next reference pass (i.e., N+L+1$^{th}$ pass) has already been acquired. When it is determined that the band data has not been acquired yet (S190: No), the processor 211 proceeds to S210 of FIG. 6, and selects the first processing. The processing following S210 is as described above. That is, the partial printing for L+1 band areas from N to N+L is performed.

When it is determined that the band data has already been acquired (S190: Yes), the processor 211 updates the reference number L to "L+1" in S230, and proceeds to S126 of FIG. 5. Then, the processor 211 executes processing for a reference band area of a new reference number L.

In the example of FIG. 12, in a case of L=2, S130 to S150 in FIG. 6 are determined as follows. Regarding S130, a black circle ejection nozzle (i.e., the non-blank pixel line) is arranged on the printing direction Dp side from the reference band area BIm(N+2) corresponding to the first processing. Therefore, the reference pass is not a final pass (S130: No). Regarding S140, the ranges of the printing target parts in the reference band areas BIm(N+2) and BIn(N+2) are different in the first processing and in the second processing. Therefore, a result of the determination in S140 is No. Regarding S150, a blank pixel line is adjacent to the reference band area BIm(N+2) on the printing direction Dp side, which corresponds to the first processing. Therefore, a result of the determination in S150 is No.

When a result of the determination in S150 of FIG. 6 is No, the processor 211 performs determination in S160 in a similar manner to S150, focusing on the reference band area BIn(N+L) corresponding to the second processing. When a non-blank pixel line is adjacent to the reference band area on the printing direction Dp side, a result of the determination in S160 is Yes. When a blank pixel line is adjacent to the reference band area on the printing direction Dp side, a result of the determination in S160 is No. In the example of FIG. 12, in the case of L=2, a blank pixel line is adjacent to the reference band area BIn(N+2) on the printing direction Dp side, which corresponds to the second processing. Therefore, a result of the determination in S160 is No.

When a result of the determination in S160 of FIG. 6 is No, the processor 211 determines in S170 whether an area in the reference band area BIm(N+L) corresponding to the first processing, which area is on the printing direction Dp side from a pixel line at an end of the reference band area BIn(N+L) on the printing direction Dp side, which corresponds to the second processing, is a blank area.

In the example of FIG. 12, in the case of L=2, a pixel line PL2 in FIG. 12 is a pixel line at an end of the reference band area BIn(N+L) on the printing direction Dp side, which corresponds to the second processing. In the reference band area BIm(N+L) corresponding to the first processing, all pixel lines PLs on the printing direction Dp side from the pixel line PL2 are blank pixel lines. Therefore, a result of the determination in S170 is Yes. In this case, specific parts (i.e., the non-blank pixel lines), which are printing target parts by three N$^{th}$ to N+2$^{th}$ partial printings corresponding to the first processing, can be printed by the three N$^{th}$ to N+2$^{th}$ partial printings even when the second processing is selected. In this way, even when the second processing is selected, the number of times of partial printings for printing of the specific parts (and, a total count of partial printings for printing of the entire target image) does not increase.

When a result of the determination in S170 of FIG. 6 is Yes, the processor 211 selects the second processing in S220, and proceeds to S310 in FIG. 7. The processing following S310 is as described above. The partial printing for the L+1 band areas from the N$^{th}$ band area to the N+L$^{th}$ band area is performed.

Figure 13:
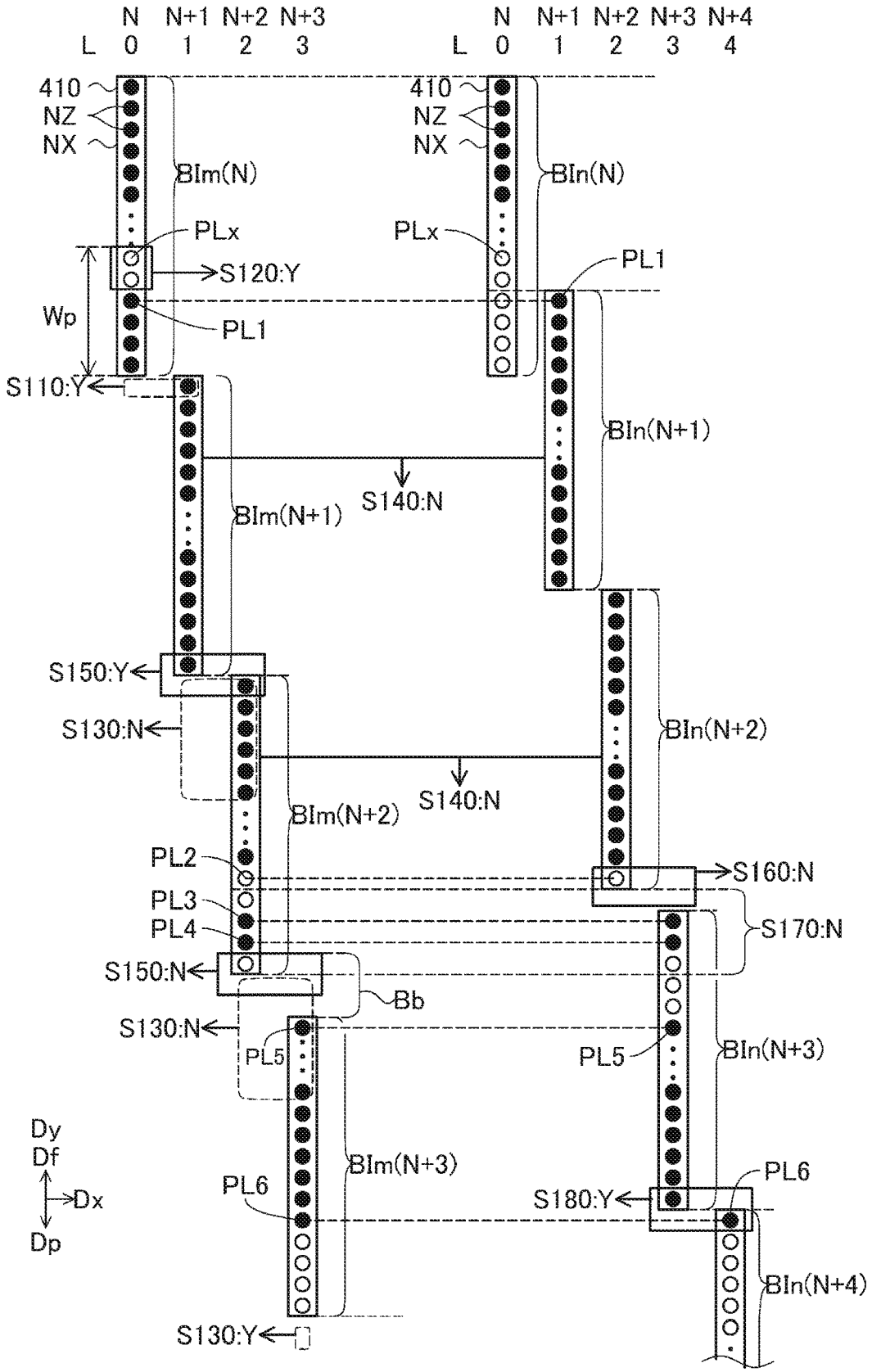
FIG. 13 depicts another example of arrangement of the nozzle groups NX (and, band areas)

FIG. 13 illustrates another example of arrangement of the nozzle groups NX (and the band areas). As with FIG. 12, arrangement corresponding to the first processing is shown on the left side, and arrangement corresponding to the second processing is shown on the right side. The arrangements of blank pixel lines in the reference band areas BIm(N+L) and BIn(N+L) corresponding to cases of L=0 and 1 are the same as those in FIG. 12. In the case of L=2, the arrangement of the blank pixel lines in the reference band area BIm(N+2) is different from that of FIG. 12. Specifically, in the reference band area BIm(N+2) corresponding to the first processing, non-blank pixel lines PL3 and PL4 are arranged on the printing direction Dp side from the pixel line PL2. As a result, a result of the determination in S170 of FIG. 6 is No.

When a result of the determination in S170 is No, the processor 211 proceeds to S190. The processing following S190 is as described above. For example, in S230, "1" is added to the reference number L, and processing for a new reference band area is executed.

In FIG. 13, in a case of L=3, in S126 of FIG. 5, the arrangement of the reference band areas BIm(N+3) and BIn(N+3) is specified. In FIG. 13, in the arrangement corresponding to the first processing, the non-blank pixel line PL4 is a pixel line at an end on the printing direction Dp side among the non-blank pixel lines in the immediately preceding band area BIm(N+2). A blank band Bb is arranged on the printing direction Dp side from the non-blank pixel line PL4, and a non-blank pixel line PL5 is arranged on the printing direction Dp side from the blank band Bb. In this case, as described in FIG. 4B and Condition B, the processor 211 determines arrangement of a reference band area BIm (N+3) so as to skip over the blank band Bb. In the example of FIG. 13, a pixel line at an end of the reference band area BIm(N+3) on the conveying direction Df side is the non-blank pixel line PLS.

Also, in the example of FIG. 13, there is not a non-blank pixel line on the printing direction Dp from the reference band area BIm(N+3) which corresponds to the first processing. In this case, since the $N+3^{th}$ pass corresponding to the first processing is a final pass, a result of the determination in S130 of FIG. 6 is Yes.

When a result of the determination in S130 is Yes, the processor 211 determines in S180 whether a part of the target image, which is to be printed, remains on the printing direction Dp side from the reference band area corresponding to the second processing. The number of the reference band area is N+L, and the reference pass N+L in the first processing is a final pass. In the second processing, an area on the printing direction Dp side from the reference band area is a printing target of $N+L+1^{th}$ partial printing and thereafter. The processor 211 determines by using the target image data whether there is a band area including a part of the target image to be printed by the $N+L+1^{th}$ partial printing and thereafter. In FIG. 13, in a case of L=3, since a non-blank pixel line PL6 is arranged on the printing direction Dp side from the reference band area BIn(N+3) which corresponds to the second processing, a result of the determination in S180 is Yes. If the first processing is selected, the non-blank pixel line PL6 is printed by $N+3^{th}$ partial printing. However, if the second processing is selected, the non-blank pixel line PL6 is printed by $N+4^{th}$ partial printing, not the $N+3^{th}$ partial printing. That is, when the first processing is selected, the entire target image is printed by the $N+3^{th}$ partial printing. However, when the second processing is selected, the printing cannot be completed by the $N+3^{th}$ partial printing, and the $N+4^{th}$ partial printing is required. In this way, when the second processing is selected, the total count of partial printings for printing of the entire target image increases.

When a result of the determination in S180 is Yes, the processor 211 proceeds to S210, and selects the first processing. The processing following S210 is as described above. That is, the partial printing for the L+1 band areas from the $N^{th}$ band area to the $N+L^{th}$ band area is performed.

Figure 14:
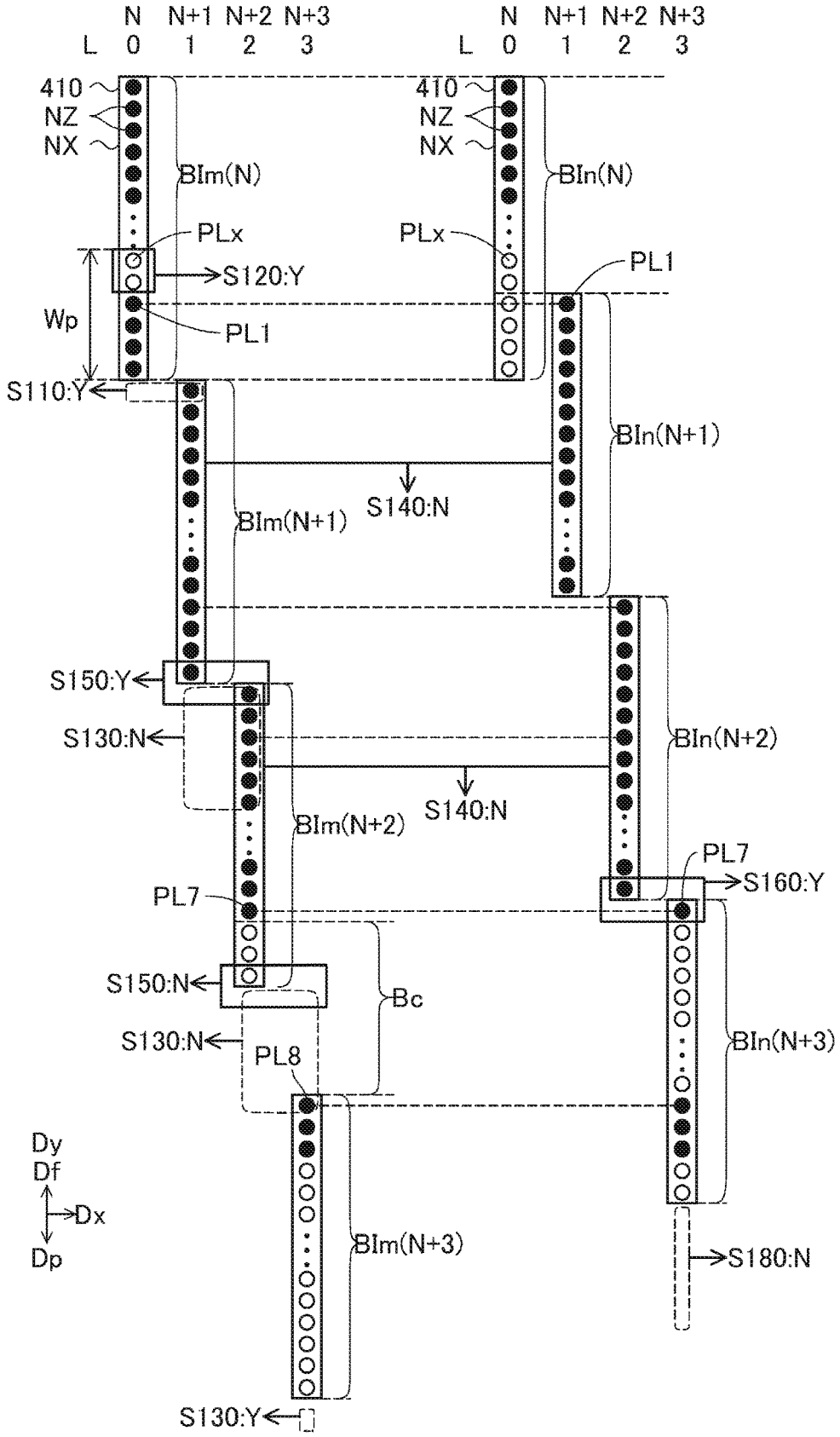
FIG. 14 depicts another example of arrangement of the nozzle groups NX (and, band areas)

FIG. 14 illustrates another example of arrangement of the nozzle groups NX (and the band areas). As with FIG. 12, arrangement corresponding to the first processing is shown on the left side, and arrangement corresponding to the second processing is shown on the right side. The arrangements of blank pixel lines in the reference band areas BIm(N+L) and BIn(N+L) corresponding to cases of L=0 and 1 are the same as those in FIG. 12. The arrangements of blank pixel lines in the reference band areas BIm(N+L) and BIn(N+L) corresponding to a case of L=2 are different from those in FIG. 12. In the meantime, results of the determinations in S130 to S150 in the case of L=2 are respectively the same as results of the determinations in S130 to S150 in the case of L=2 in FIG. 12.

In FIG. 14, a non-blank pixel line PL7 is a non-blank pixel line in the reference band area BIm(N+2) corresponding to the first processing. The non-blank pixel line PL7 is not included in the reference band area BIn(N+2) corresponding to the second processing, and is adjacent to the reference band area BIn(N+2) on the printing direction Dp. Therefore, a result of the determination in S160 of FIG. 6 is Yes.

When a result of the determination in S160 is Yes, the processor 211 proceeds to S190. The processing following S190 is as described above. For example, in S230, "1" is added to the reference number L, and processing for a new reference band area is executed.

In FIG. 14, in a case of L=3, in S126 of FIG. 5, arrangements of the reference band areas BIm(N+3) and BIn(N+3) are specified. In the arrangement corresponding to the first processing, a non-blank pixel line PL7 is a pixel line at an end on the printing direction Dp side among the non-blank pixel lines in the immediately preceding band area BIm(N+2). A blank band Bc is arranged on the printing direction Dp side from the non-blank pixel line PL7, and a non-blank pixel line PL8 is arranged on the printing direction Dp side from the blank band Bc side. In this case, as described in FIG. 4B and Condition B, the processor 211 determines arrangement of the reference band area BIm(N+3) so as to skip over the blank band Bc. In the example of FIG. 14, a pixel line at an end of the reference band area BIm(N+3) on the conveying direction Df side is the non-blank pixel line PL8.

Also, in the example of FIG. 14, a non-blank pixel line is not provided on the printing direction Dp side from the reference band area BIm(N+3) which corresponds to the first processing. In this case, since the $N+3^{th}$ pass corresponding to the first processing is a final pass, a result of the determination in S130 of FIG. 6 is Yes.

When a result of the determination in S130 is Yes, the processor 211 determines in S180 whether a part of the target image, which is to be printed, remains on the printing direction Dp side from the reference band area corresponding to the second processing. In FIG. 14, in a case of L=3, since there is not a non-blank pixel line on the printing direction Dp side from the reference band area BIn(N+3) corresponding to the second processing. Therefore, a result of the determination in S180 is No. In this case, the $N^{th}$ to $N+3^{th}$ partial printings, which are executed when the second processing is selected, can print all the non-blank pixel lines of printing targets of the $N^{th}$ to $N+3^{th}$ partial printings to be executed when the first processing is selected. In this way, even when the second processing is selected, the number of times of partial printings (and, a total count of partial printings for printing of the entire target image) does not increase.

When a result of the determination in S180 of FIG. 6 is No, the processor 211 selects the second processing in S220, and proceeds to S310 in FIG. 7. The processing following S310 is as described above. That is, the partial printing for the L+1 band areas from the $N^{th}$ band area to the $N+L^{th}$ band area is performed.

Figure 15:
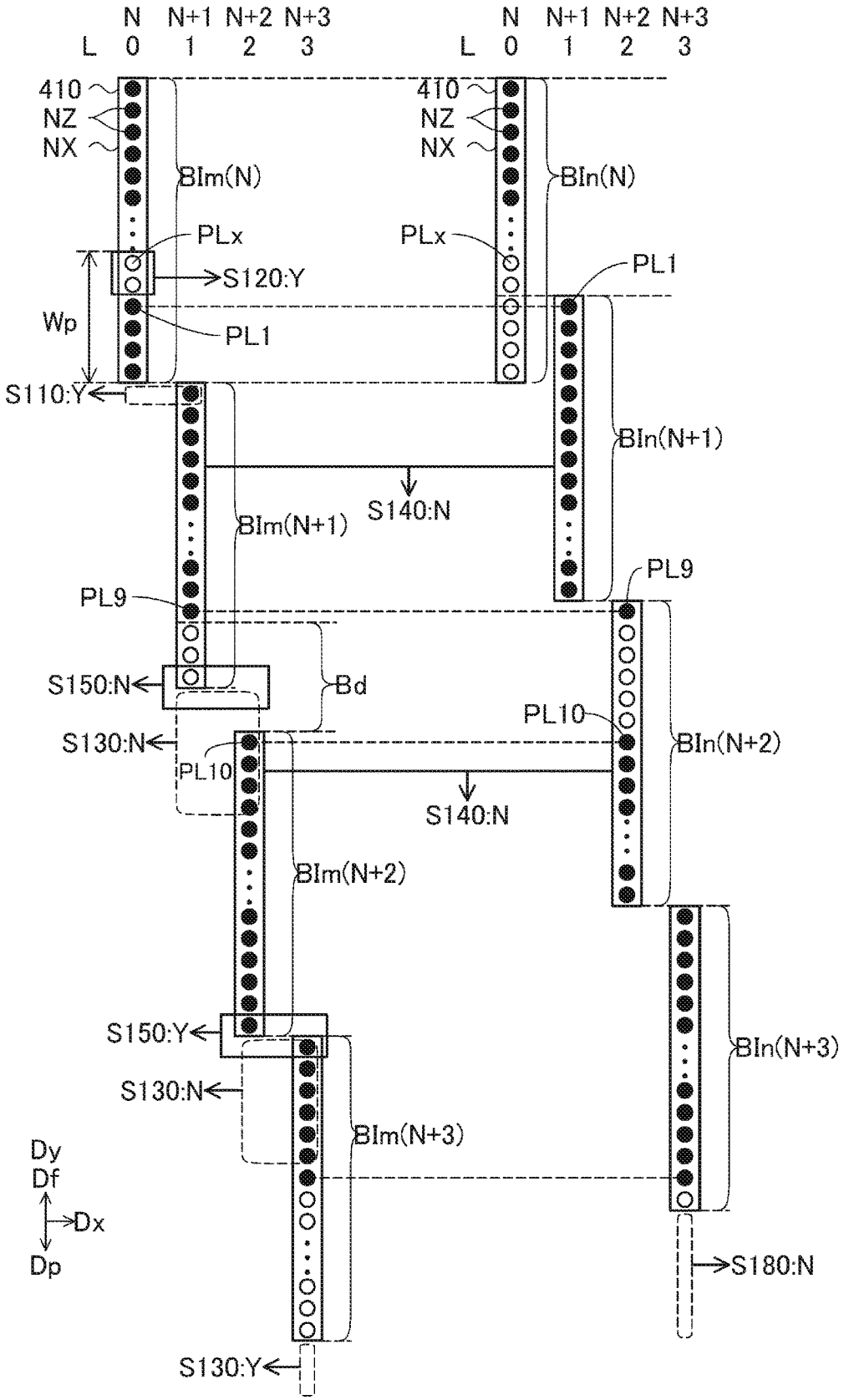
FIG. 15 depicts another example of arrangement of the nozzle groups NX (and, band areas).

FIG. 15 illustrates another example of arrangement of the nozzle groups NX (and the band areas). As with FIG. 12, arrangement corresponding to the first processing is shown on the left side, and arrangement corresponding to the second processing is shown on the right side. The arrangements of blank pixel lines in the reference band areas BIm(N) and BIn(N) are the same as those in FIG. 12. In the case of L=1, the arrangement of blank pixel lines in the reference band area BIm(N+1) is different from those in FIG. 12. In the meantime, results of the determinations in S130 and S140 in the case of L=1 are respectively the same as results of the determinations in S130 and S140 in the case of L=1 in FIG. 12.

In FIG. 15, a non-blank pixel line PL9 is a non-blank pixel line in the reference band area BIm(N+1) corresponding to the first processing in the case of L=1. A blank band Bd is arranged on the printing direction Dp side from the non-blank pixel line PL9. A non-blank pixel line of the blank band Bd is adjacent to the reference band area BIm(N+1) on the printing direction Dp side. Therefore, a result of the determination in S150 of FIG. 6 is No.

In S160, the processor 211 performs the determination for the reference band area BIn(N+1) corresponding to the second processing. The non-blank pixel line PL9 is adjacent to the reference band area BIn(N+1) on the printing direction Dp. Therefore, a result of the determination in S160 is Yes. In this case, the processor 211 proceeds to S190. The processing following S190 is as described above. For example, in S230, "1" is added to the reference number L, and processing for a new reference band area is executed.

In FIG. 15, in the case of L=2, in S126 of FIG. 5, arrangements of the reference band areas BIm(N+2) and BIn(N+2) are specified. In the arrangement corresponding to the first processing, the non-blank pixel line PL9 is a pixel line at an end on the printing direction Dp side among the non-blank pixel lines in the immediately preceding band area BIm(N+1). A blank band Bd is arranged on the printing direction Dp side from the non-blank pixel line PL9, and a non-blank pixel line PL10 is arranged on the printing direction Dp side from the blank band Bd. In this case, as described in FIG. 4B and Condition B, the processor 211 determines arrangement of the reference band area BIm(N+2) so as to skip over the blank band Bd. In the example of FIG. 15, a pixel line at an end of the reference band area BIm(N+2) on the conveying direction Df side is a non-blank pixel line PL10.

Also, in the example of FIG. 15, since a non-blank pixel line is provided on the printing direction Dp side from the reference band area BIm(N+2) corresponding to the first processing, a result of the determination in S130 of FIG. 6 is No. Regarding S140, the ranges of the printing target parts in the reference band areas BIm(N+2) and BIn(N+2) are different in both the first processing and the second processing. Therefore, a result of the determination in S140 is No. Regarding S150, a non-blank pixel line is adjacent to the reference band area BIm(N+2) on the printing direction Dp side which corresponds to the first processing. Therefore, a result of the determination in S150 is Yes. In this case, the processor 211 proceeds to S190. The processing following S190 is as described above. For example, in S230, "1" is added to the reference number L, and processing for a new reference band area is executed.

In FIG. 15, in the case of L=3, in S126 of FIG. 5, arrangements of the reference band areas BIm(N+3) and BIn(N+3) are specified. In the arrangement corresponding to the first processing, the reference band area BIm(N+3) is adjacent to the immediately preceding band area BIm(N+2) on the printing direction Dp. Also, in the example of FIG. 15, a non-blank pixel line is not provided on the printing direction Dp side from the reference band area BIm(N+3) corresponding to the first processing. In this case, since the $N+3^{th}$ pass corresponding to the first processing is a final pass, a result of the determination in S130 of FIG. 6 is Yes. Regarding S180, a non-blank pixel line is not provided on the printing direction Dp side from the reference band area BIn(N+3) corresponding to the second processing. Therefore, a result of the determination in S180 is No. In this case, the processor 211 selects the second processing in S220, and proceeds to S310 in FIG. 7. The processing following S310 is as described above. That is, the partial printing for the L+1 band areas from the $N^{th}$ band area to the $N+L^{th}$ band area is performed.

As described above, in the present embodiment, the print execution unit 400 in FIGS. 1 and 2 includes a plurality of elements such as the print head 410, the conveyor 440, and the main scanning unit 430. The print head 410 in FIG. 3 has the nozzle groups NK, NY, NC and NM for ejecting inks. The conveyor 440 in FIG. 2 executes conveyance of moving the sheet PM relative to the print head 410 in the conveying direction Df. The main scanning unit 430 in FIG. 2 performs the main scanning of moving the print head 410 relative to the sheet PM in a direction parallel to the Dx direction perpendicular to the conveying direction Df.

As described in FIGS. 4A and 4B, the control device 299 of the multi-function device 200 in FIG. 1 causes the print execution unit 400 to print an image by repetitively executing: the partial printing of causing the print head 410 to eject the inks while causing the main scanning unit 430 to perform the main scanning; and conveying processing of causing the conveyor 440 to perform the conveyance.

Herein, the processor 211 of the control device 299 determines in S120 of FIG. 5 whether the $N^{th}$ band area, which is a band area of a printing target of the $N^{th}$ partial printing, includes a blank pixel line. N is an integer equal to or greater than 1. When the $N^{th}$ band area includes a blank pixel line (S120: Yes), the processor 211 selects one of the first processing and the second processing so as to print the $N^{th}$ band area by the processing of S123 to S220 of FIG. 5 and FIG. 6. Herein, the first processing is processing of causing the print execution unit 400 to print the entire $N^{th}$ band area, such as the $N^{th}$ band area BI(N) of FIG. 11, by executing the $N^{th}$ partial printing. The second processing is processing of printing the $N^{th}$ band area, such as the $N^{th}$ band BIn(N) on the right side of FIG. 12, by executing the two partial printings of the $N^{th}$ partial printing and the $N+1^{th}$ partial printing. In the example of FIG. 12, the second processing causes the print execution unit 400 to print a pre-stage part P1, which is a part located at a position shifted toward the conveying direction Df with respect to the blank pixel line PLx, of the $N^{th}$ band area BIn(N) by the $N^{th}$ partial printing. Also, the second processing causes the print execution unit 400 to print a post-stage part P2, which is a part located at a position shifted toward the printing direction Dp opposite to the conveying direction Df with respect to the blank pixel line PLx, of the $N^{th}$ band area BIn(N) by executing the $N+1^{th}$ partial printing.

The processor 211 specifies arrangement of each band area and each band image for processing selected from the first processing and the second processing, in S405 of FIG. 10. Then, the control device 299 executes the processing of FIG. 10, in accordance with the specified arrangement of the band area and the specified band image, thereby causing the print execution unit 400 to execute the partial printing.

Herein, as described in FIG. 5 and FIG. 6, the processor 211 selects the second processing when a condition (also referred to as "total count condition"), which indicates that a total count of the partial printings for printing of the entire target image in the case in which the second processing is assumed to be executed is equal to or smaller than a total count of the partial printings for printing of the entire target image in the case in which the first processing is assumed to be executed, is satisfied (S140: Yes, S170: Yes, S180: No). When the second processing is executed, a boundary between a part, which is printed by the $N^{th}$ partial printing, of the band area BIn(N) by the $N^{th}$ partial printing and a part, which is printed by the $N+1^{th}$ partial printing, of the band area BIn(N+1) by the $N+1^{th}$ partial printing is formed by the blank pixel line PLx, as shown on the right side in FIG. 12. Therefore, it is possible to suppress the boundary between the band area by the $N^{th}$ partial printing and the band area by the $N+1^{th}$ partial printing from being noticed. Also, the processor 211 selects the first processing when the total count condition is not satisfied. Therefore, it is possible to suppress an increase in printing time.

Also, as described in S130, S180 of FIG. 6 and FIG. 13, in the case in which the first processing is assumed to be executed, the processor 211 determines in S130 whether the reference pass, which is a $N+L^{th}$ pass, is a final pass for printing of the target image. An affirmative result of the determination (Yes) indicates that the total count of the partial printings for printing of the entire target image in the case in which the first processing is assumed to be executed is N+L. When a result of the determination in S130 is Yes, the processor 211 determines in S180 whether a part of the target image remains in an area located at a position shifted toward the printing direction Dp with respect to the reference band area in the case in which the second processing is assumed to be executed. That is, in the case in which the second processing is assumed to be executed, the processor 211 determines whether there is a band area including a part, which is to be printed by the $N+L+1^{th}$ partial printing and thereafter, of the target image. When a result of the determination in S180 is Yes, the processor 211 selects the first processing in S210 (i.e., the processor 211 determines that the total count condition is not satisfied). Therefore, the processor 211 can determine as appropriate whether the total count condition is satisfied or not.

In the meantime, as described in S170 of FIG. 6, FIG. 12, S180 of FIG. 6, FIG. 14, and FIG. 15, in the case in which the second processing is assumed to be executed, when the total count of the partial printings for printing of the entire target image does not increase, as compared to the case in which the first processing is assumed to be executed, the processor 211 selects the second processing in S220 (i.e., the processor 211 determines that the total count condition is satisfied). Therefore, the processor 211 can appropriately determine that the total count condition is satisfied.

Also, as described in S126 of FIG. 5 and S230 of FIG. 6, the processor 211 specifies the arrangement of the band area from the $N+1^{th}$ band area toward the printing direction Dp side in the case in which the second processing is assumed to be executed, one by one sequentially from the $N+1^{th}$ band area toward the printing direction Dp. Then, as described in the example of FIG. 12, the processor 211 can determine that the total count condition is satisfied by using the arrangement of the $N+L^{th}$ band area (FIG. 6: Yes in S170). L is an integer equal to or greater than 1. In this case, the processor 211 selects the second processing in S220 without specifying the arrangement of the band area from the $N+L+1^{th}$ band area toward the printing direction Dp side. The $N+L^{th}$ band area may be a band area on the conveying direction Df side from a final band area for printing of the entire target image. In this way, the processor 211 can determine rapidly whether the total count condition is satisfied, before the specifying of the arrangements of all the band areas for printing of the target image is completed.

Herein, when a result of the determination in S140 of FIG. 6 is Yes, the processor 211 selects the second processing in S220. A first condition for a result of the determination in S140 to be Yes indicates that the range of the remaining printing target part except a blank pixel line in the reference band area ($N+L^{th}$ band area), is the same in both the case in which the first processing is assumed to be executed and the case in which the second processing is assumed to be executed. The processor 211 can determine appropriately whether the total count condition is satisfied by using the first condition for the determination.

Also, when a result of the determination in S170 of FIG. 6 is Yes, the processor 211 selects the second processing in S220. A second condition for a result of the determination in S170 to be Yes includes that, in the $N+L^{th}$ band area in the case in which the first processing is to be executed, all the pixel lines located at a position shifted toward the printing direction with respect to a pixel line, which is located at the same position as a position of an end of the $N+L^{th}$ band area in the printing direction Dp in the case in which the second processing is assumed to be executed, are blank pixel lines. As described in the example of FIG. 12, the processor 211 can determine appropriately whether the total count condition is satisfied by using the second condition for the determination.

Also, as described in S160 of FIG. 6, the second condition includes that the pixel line adjacent to the printing direction side of the $N+L^{th}$ band area in the case in which the second processing is assumed to be executed is a blank pixel line. As described in the example of FIG. 12, the processor 211 can determine appropriately whether the total count condition is satisfied by using the second condition for the determination.

Also, as described in S150 of FIG. 6, the second condition includes that the pixel line adjacent to the printing direction side of the $N+L^{th}$ band area in the case in which the first processing is assumed to be executed is a blank pixel line. As described in the example of FIG. 12, the processor 211 can determine appropriately whether the total count condition is satisfied by using the second condition for the determination.

Also, as described in FIG. 6, when a specific condition, which includes that the total count condition is not satisfied for the $N+L^{th}$ band area, is satisfied, the processor 211 determines whether the total count condition is satisfied for a next $N+L+1^{th}$ band area. Specifically, the specific condition includes that at least one of the three conditions "S150: Yes", "S160: Yes", and "S170: No" is satisfied. The processor 211 can determine appropriately whether the total count condition is satisfied by using the specific condition for the determination.

Also, as described in S60 of FIG. 5, the processor 211 acquires the target image data. Also, as described in S190 of FIG. 6, when partial data, which is image data of the $N+L+1^{th}$ band area of the target image, has already been acquired (S190: Yes), the processor 211 determines whether the total count condition is satisfied for the $N+L+1^{th}$ band area. Also, when the partial data has not been acquired yet (S190: No), the processor 211 selects the first processing in S210. In this way, since the processor 211 proceeds with the processing when the partial data has already been acquired, it is possible to suppress an increase in printing time.

Also, as described in FIG. 6, the processor 211 determines in S130 whether the reference pass in the case in which the first processing is assumed to be executed is a final pass for printing of the target image. When a result of the determination in S130 is Yes, the processor 211 determines in S180 whether there is a non-blank pixel line at a position shifted toward the printing direction Dp with respect to the reference band area BIn(N+L) corresponding to the second processing. When there is not a non-blank pixel line on the printing direction Dp side from the reference band area BIn(N+L) corresponding to the second processing (S180: No), the processor 211 selects the second processing in S220 (i.e., the processor 211 determines that the total count condition is satisfied). Also, when there is a non-blank pixel line at a position shifted toward the printing direction Dp with respect to the reference band area BIn(N+L) corresponding to the second processing (S180: Yes), the processor 211 selects the first processing in S210 (i.e., the processor 211 determines that the total count condition is not satisfied). The processor 211 can determine appropriately whether the total count condition is satisfied by using the condition for the determination.

Also, as described in FIG. 5 to FIG. 7, the processor 211 can select one of the first processing and the second processing by using the arrangements of the reference band areas BIm(N+L) and BIn(N+L). When the second processing is determined to be selected, the processor 211 executes the second processing (S310 of FIG. 7) before the arrangements of all the band areas for printing of the entire target image are specified. Therefore, it is possible to suppress the boundary between the band area by the $N^{th}$ partial printing and the band area by the $N+1^{th}$ partial printing from being noticed without an increase in printing time.

Also, as described in FIG. 12 and the like, the processor 211 determines in S120 of FIG. 5 whether a blank pixel line is within a part of the $N^{th}$ band area BIm(N), which has the predetermined width Wp and includes an end of the $N^{th}$ band area BIm(N) on the printing direction Dp side. If the second processing is executed based on a blank pixel line that is within the part of the $N^{th}$ band area BIm(N) on the conveying direction Df side, the moving amount of the band area in the conveying direction Df increases. As a result, there is a high possibility that the total count of the partial printings for printing of the entire target image will increase (i.e., a possibility that the total count condition will not be satisfied is high). In the present embodiment, when a possibility that the total count condition will not be satisfied is high, the processing of determining whether the total count condition is satisfied is suppressed. Therefore, it is possible to increase an increase in printing time. However, the processor 211 may determine Yes in S120 when the blank pixel line is within the $N^{th}$ band area BIm(N), irrespective of a position in the $N^{th}$ band area BIm(N).

Also, as described in S65 of FIG. 5, the processor 211 specifies a blank pixel line in the target image by using the image data of the target image. Therefore, the processor 211 can suppress the boundary between the two adjacent band areas from being noticed by using an appropriate blank pixel line.

B. Modified Embodiments (1) The selection processing for selecting one of the first processing and the second processing may be other diverse processing, instead of the processing of FIG. 5 to FIG. 7. For example, the processor 211 may proceed with the selection processing after completing the acquisition of the entire target image data in S60 of FIG. 5. In this case, the processing of S190 in FIG. 6 is omitted. Also, the processor 211 may proceed with the selection processing after completing the specifying of the blank pixel line in S65. Also, after specifying the arrangements of all the band areas in the case in which the first processing is assumed to be executed and the arrangements of all the band areas in the case in which the second processing is assumed to be executed, the processor 211 may select one processing in accordance with a comparison result of the total counts of the partial printings.

Also, the image data that is to be used in the selection processing may be other diverse image data, instead of the image data (in the above embodiment, the RGB bitmap data) before the color conversion processing. For example, the color-converted image data or the dot data may be used. For example, in S65, the processor 211 may specify the blank pixel lines by using CMYK bitmap data or bitmap data. In any case, when a color value of a pixel indicates the brightest white within an available range of color values, the corresponding pixel may be specified as a blank pixel.

(2) The processing of specifying the blank pixel line may be other diverse processing, instead of the processing shown in FIG. 8. For example, the processor 211 may determine for all pixels of the target image whether a pixel is a blank pixel, and specify a blank pixel line by using a result of the determination. In the meantime, since the processing of FIG. 8 uses some pixels of all pixels of the target image, it is possible to shorten time necessary to specify the blank pixel line.

(3) The condition for skipping over the blank band of FIG. 4B may be diverse conditions. For example, when the width Wb is equal to or greater than a threshold value Wbt that is set in advance, the skipping may be executed. In the above embodiment, the width Wb is indicated by the number of pixel lines, and the threshold value Wbt is "1". Herein, the threshold value Wbt may be 2 or greater. Also, the skipping of the blank band may be omitted, irrespective of the width Wb.

(4) The halftone processing may be other diverse processing such as an error diffusion method, instead of the processing of using the dither matrix. When the halftone processing of using the dither matrix is executed, a result of the halftone processing does not influence the plurality of pixels. Therefore, the processor 211 can specify a blank pixel by using a color value of any color space. In a case in which the halftone processing is processing in which an error spreads among a plurality of pixels, such as an error diffusion method, a dot may be formed on a pixel indicative of the brightest white, due to an error. Herein, the halftone processing may be executed, in accordance with a rule "an error is calculated without forming a dot on a pixel indicative of the brightest white". In this case, the processor 211 can specify a blank pixel by using a color value of any color space.

(5) The configuration of the print execution unit 400 may be other diverse configurations, instead of the configuration of the embodiment shown in FIG. 1, FIG. 2 and FIG. 3. For example, the number E of types of useable inks may be any number equal to or greater than 1. Also, the print head 410 may have E nozzle groups arranged side by side in the main scanning direction, as E nozzle groups for ejecting the E types of inks. The respective positions of the plurality of nozzles configuring one nozzle group (i.e., the plurality of nozzles for ejecting the same ink) in the sub-scanning direction are preferably different from each other. In the embodiment of FIG. 3, the positions of the plurality of nozzles NZ belonging to each nozzle group in the main scanning direction are the same. Instead, the plurality of nozzles NZ of one nozzle group may include a plurality of nozzles NZ of which positions in the main scanning direction are different from each other. Also, the cartridge mounting unit 451 may be fixed to the carriage 433. The platen PT may be omitted. The configuration of the sub-scanning unit 440 may be any configuration for moving the sheet PM in the sub-scanning direction. For example, the sub-scanning unit 440 may include a roller configured to convey the printing medium on any of upstream and downstream sides of the print head. The configuration of the main scanning unit 430 may be any configuration for moving the print head relative to the printing medium in the main scanning direction.

(6) In the above embodiment, the multi-function device 200 is an example of a printing apparatus including the print execution unit 400. The scanner unit 280 may be omitted. The control device 299 is an example of a control device of the printing apparatus including the print execution unit 400. Also, the control device 299 is an example of a control device configured to control the print execution unit 400. At least one of the display unit 240 and the operation unit 250 may be omitted.

Also, the processing of FIGS. 5 to 7 of generating the print data by using the target image data may be executed by an external apparatus connected to the multi-function device 200, instead of the control device 299 of the multi-function device 200. For example, the processor 110 of the terminal apparatus 100 shown in FIG. 1 may be configured to generate a plurality of partial printing data for multiple number of times of partial printings by executing the processing of FIG. 5 to FIG. 7 in accordance with the program 132, and to supply the plurality of generated partial printing data to the multi-function device 200. The processor 211 of the multi-function device 200 may be configured to cause the print execution unit 400 to print an image by supplying the plurality of received partial printing data to the motor controller 214 in printing order. In this case, the multi-function device 200 is an example of the print execution unit, and the external apparatus is an example of the control device configured to control the multi-function device 200 (and the print execution unit).

Also, the external apparatus may be configured to generate print data including dot data, which indicates the entire target image, and arrangement data, which indicates arrangement of blank pixel lines. The external apparatus may be configured to supply the generated print data to the multi-function device 200. The processor 211 of the multi-function device 200 may be configured to specify a band area including a blank pixel line by referring to the arrangement data, to execute the processing of selecting one of the first processing and the second processing, to generate a plurality of partial printing data based on the selected processing, and to cause the print execution unit 400 to execute the multiple number of times of partial printings by using the plurality of partial printing data. In this way, the blank pixel line may be specified by the external apparatus.

In the respective embodiments, some of the configuration implemented by hardware may be replaced with software, and some or all of the configuration implemented by software may be replaced with hardware. For example, the processing of S65 in FIG. 5 may be implemented by a dedicated hardware circuit.

When some or all of the functions of the present disclosure are implemented by a computer program, the program may be provided with being stored on a computer-readable recording medium (for example, a non-transitory recording medium). The program may be used with being stored on a recording medium (a computer-readable recording medium), which is the same as or different from the recording medium in which the program has been originally provided. The "computer-readable recording medium" is not limited to a portable recording medium such as a memory card and a CD-ROM, but may include an internal storage device provided in a computer, such as various ROMs, and an external storage device connected to the computer, such as a hard disk drive.

In the respective embodiments, the conveyor 440 is configured such that the sheet PM is conveyed by the pair of upstream rollers and the pair of downstream rollers, but is not limited thereto. For example, the conveyor 440 may be configured such that the sheet attracted on a surface of an endless belt is conveyed by traveling the endless belt. The sheet may be electrostatically attracted on the surface of the endless belt, or may be attracted on the surface of the endless belt such that air is absorbed toward a hole provided on the endless belt by a suction unit. Also, the conveyor 440 may be a stand configured to support the sheet PM and to move in the conveying direction together with the sheet PM.

As described the above, the controller, the printing apparatus, and the non-transitory computer-readable medium according to the present disclosure is applied to a printer that records an image on the sheet PM and ejects ink from the nozzle, but is not limited thereto. For example, the controller, the printing apparatus, and the non-transitory computer-readable medium according to the present disclosure may be applied to a printer that prints an image on a long paper such as a rolled paper instead of a single sheet PM. Also, the controller, the printing apparatus, and the non-transitory computer-readable medium according to the present disclosure may be applied to a printer that prints an image on a printing medium, which is not the recording sheet, such that a T-shirt, an outdoor advertising sheet, a case for a portable terminal such as a smart phone, a cardboard, and a resin member. Further, the controller, the printing apparatus, and the non-transitory computer-readable medium according to the present disclosure may be applied to a printer that ejects liquid, which is not ink, such as liquid resin and liquid metal.

While the present disclosure has been described with reference to the embodiment and modified embodiments thereof, the embodiments are provided so as to easily understand the present disclosure, not to limit the present disclosure. The present disclosure can be changed and improved without departing from the gist thereof, and includes equivalents thereto.

What is claimed is:

1. A control device for causing a print execution unit to print an image, the print execution unit comprising: a print head having a nozzle group for ejecting ink; a conveyor configured to perform conveyance of moving a printing medium relative to the print head in a first direction; and a main scanning unit configured to perform main scanning of moving the print head relative to the printing medium in a direction parallel to a second direction perpendicular to the first direction, the control device being configured to cause the print execution unit to print the image by repetitively executing:

Partial printing of causing the print head to eject the ink toward the printing medium while causing the main scanning unit to perform the main scanning; and conveying processing of causing the conveyor to perform the conveyance, wherein the control device is configured to execute:

selection processing of selecting one of first processing and second processing for printing an $N^{th}$ band area, which is a band area extending in the second direction on a target image of one page and is a printing target of $N^{th}$ partial printing, when the $N^{th}$ band area includes a blank pixel line extending in the second direction, N being an integer equal to or greater than 1, the first processing being processing of causing the print execution unit to print the entire $N^{th}$ band area by executing the $N^{th}$ partial printing, and the second processing being processing of causing the print execution unit to print a pre-stage part, which is a part located at a position shifted toward the first direction with respect to the blank pixel line, of the $N^{th}$ band area by executing the $N^{th}$ partial printing, the second processing being processing of causing the print execution unit to print a post-stage part, which is a part located at a position shifted toward a printing direction opposite to the first direction with respect to the blank pixel line, by executing $N+1^{th}$ partial printing; and execution processing of executing the one of the first processing and the second processing which is selected in the selection processing, and wherein, in the selection processing, the control device is configured to:

select the second processing when a total count condition is satisfied, the total count condition indicating that a total count of the partial printings for printing of the entire target image in a case in which the second processing is assumed to be executed is equal to or smaller than a total count of the partial printings for printing of the entire target image in a case in which the first processing is assumed to be executed; and select the first processing when the total count condition is not satisfied.

2. The control device according to claim 1, wherein, in the selection processing, the control device is configured to:

specify a total count M of the partial printings for printing of the entire target image in the case in which the first processing is assumed to be executed, M being an integer equal to or greater than N; and determine that the total count condition is not satisfied when there is a band area including a part, which is to be printed by $M+1^{th}$ partial printing and thereafter, of the target image in the case in which the second processing is assumed to be executed.

3. The control device according to claim 1, wherein, in the selection processing, the control device is configured to:

specify arrangement of band areas from a $N+1^{th}$ band area toward the printing direction in the case in which the second processing is assumed to be executed, one by one sequentially from the $N+1^{th}$ band area toward the printing direction; and select the second processing without specifying arrangement of a band area from a $N+L+1^{th}$ band area toward the printing direction when the total count condition is determined to be satisfied by using arrangement of a $N+L^{th}$ band area located at a position shifted toward the first direction with respect to a final band area for printing of the entire target image, L being an integer equal to or greater than 1.

4. The control device according to claim 3, wherein the total count condition is satisfied when a first condition is satisfied, the first condition indicating that a range of a remaining printing target part except a blank pixel line in the $N+L^{th}$ band area is the same in both the case in which the first processing is assumed to be executed and the case in which the second processing is assumed to be executed.

5. The control device according to claim 4, wherein, in the selection processing, the control device is configured to determine whether the total count condition is satisfied for the $N+L+1^{th}$ band area, when a specific condition, which includes that the total count condition is not satisfied for the $N+L^{th}$ band area, is satisfied.

6. The control device according to claim 5, wherein the control device is configured to acquire image data of the target image, and wherein, in the selection processing, the control device is configured to:

determine whether the total count condition is satisfied for the $N+L+1^{th}$ band area, when partial data, which is image data of the $N+L+1^{th}$ band area, of the target image has already been acquired; and select the first processing when the partial data has not been acquired yet.

7. The control device according to claim 3, wherein the total count condition is satisfied when a second condition is satisfied, the second condition including that, in the $N+L^{th}$ band area in the case in which the first processing is assumed to be executed, all pixel lines located at a position shifted toward the printing direction with respect to a pixel line, which is located at a same position as a position of an end of the $N+L^{th}$ band area in the printing direction in the case in which the second processing is assumed to be executed, are blank pixel lines.

8. The control device according to claim 7, wherein the second condition includes that a pixel line adjacent to an area, in the printing direction, of the $N+L^{th}$ band area in the case in which the second processing is assumed to be executed is a blank pixel line.

9. The control device according to claim 7, wherein the second condition includes that a pixel line adjacent to an area, in the printing direction, of the $N+L^{th}$ band area in the case in which the first processing is assumed to be executed is a blank pixel line.

10. The control device according to claim 3, wherein the total count condition is satisfied when $N+L^{th}$ partial printing in the case in which the first processing is assumed to be executed is final partial printing for printing of the entire target image and when there is not a non-blank pixel line at a position shifted toward the printing direction with respect to the $N+L^{th}$ band area in the case in which the second processing is assumed to be executed, and wherein the total count condition is not satisfied when the $N+L^{th}$ partial printing in the case in which the first processing is assumed to be executed is the final partial printing for printing the entire target image and when there is the non-blank pixel line at the position shifted toward the printing direction with respect to the $N+L^{th}$ band area in the case in which the second processing is assumed to be executed.

11. The control device according to claim 3, wherein, in the execution processing, when the total count condition is determined to be satisfied by using the arrangement of the $N+L^{th}$ band area, the control device executes the second processing before arrangements of all band areas for printing of the entire target image are specified.

12. The control device according to claim 1, wherein the blank pixel line is within a part of the $N^{th}$ band area, the part of the $N^{th}$ band area having a predetermined width and including an end, in the printing direction, of the $N^{th}$ band area.

13. The control device according to claim 1, wherein the control device is configured to specify the blank pixel line in the target image by using image data of the target image.

14. A printing apparatus comprising:

the control device according to claim 1; and the printing execution unit.

15. A non-transitory computer-readable recording medium storing a computer program readable by a computer configured to cause a print execution unit to print an image, the print execution unit comprising: a print head having a nozzle group for ejecting ink; a conveyor configured to perform conveyance of moving a printing medium relative to the print head in a first direction; and a main scanning unit configured to perform main scanning of moving the print head relative to the printing medium in a direction parallel to a second direction perpendicular to the first direction, the computer program, when executed by the computer, causing the computer to cause the print execution unit to print the image by repetitively performing:

partial printing of causing the print head to eject the ink while causing the main scanning unit to perform the main scanning; and conveying processing of causing the conveyor to perform the conveyance, wherein the computer program, when executed by the computer, causes the computer to perform:

selection processing of selecting one of first processing and second processing for printing an $N^{th}$ band area, which is a band area extending in the second direction on a target image of one page and is a printing target of $N^{th}$ partial printing, when the $N^{th}$ band area includes a blank pixel line extending in the second direction, N being an integer equal to or greater than 1, the first processing being processing of causing the print execution unit to print the entire $N^{th}$ band area by executing the $N^{th}$ partial printing, and the second processing being processing of causing the print execution unit to print a pre-stage part, which is a part on a first direction side located at a position shifted toward the first direction with respect to the blank pixel line, of the $N^{th}$ band area by executing the $N^{th}$ partial printing, the second processing being processing of causing the print execution unit to print a post-stage part, which is a part located at a position shifted toward a printing direction opposite to the first direction with respect to the blank pixel line, by executing $N+1^{th}$ partial printing; and execution processing of executing the one of the first processing and the second processing which is selected in the selection processing, and wherein, in the selection processing, the computer program, when executed by the computer, causes the computer to perform:

selecting the second processing when a total count condition is satisfied, the total count condition indicating that a total count of the partial printings for printing the entire target image in a case in which the second processing is assumed to be executed is equal to or smaller than a total count of the partial printings for printing the entire target image in a case in which the first processing is assumed to be executed; and selecting the first processing when the total count condition is not satisfied.

* * * * *